US007431657B2

(12) United States Patent
Whitehead, II et al.

(10) Patent No.: US 7,431,657 B2
(45) Date of Patent: Oct. 7, 2008

(54) FUNCTIONAL CONTROL / GRIP-ENHANCED SPORTS GLOVE FOR BOWLING

(76) Inventors: Marshall Edward Whitehead, II, 125 Park Meadow Dr. - #E, Elyria, OH (US) 44035; Mayumi Wachi Whitehead, 125 Park Meadow Dr. - #E, Elyria, OH (US) 44035; Marshall Edward Whitehead, 125 Park Meadow Dr. - #E, Elyria, OH (US) 44035

( * ) Notice: Subject to any disclaimer, the term of this patent is extended or adjusted under 35 U.S.C. 154(b) by 0 days.

(21) Appl. No.: 11/373,809

(22) Filed: Mar. 10, 2006

(65) Prior Publication Data

US 2006/0205526 A1 Sep. 14, 2006

Related U.S. Application Data

(60) Provisional application No. 60/661,417, filed on Mar. 14, 2005.

(51) Int. Cl.
*A41D 19/00* (2006.01)

(52) U.S. Cl. ..... 473/59; 2/161.1; 2/161.3; 2/161.6; 473/61

(58) Field of Classification Search ..... 473/61; 2/16, 20, 21, 907, 161.1–161.5, 163, 169; 601/40; 482/47, 48, 49; 602/21, 22
See application file for complete search history.

(56) References Cited

U.S. PATENT DOCUMENTS 852,972 A * 5/1907 Mackay ..... 2/161.6
1,642,311 A * 9/1927 Richardson ..... 56/328.1
2,391,851 A * 12/1945 Willard ..... 2/21
2,555,203 A * 5/1951 Ramsey ..... 219/211
(Continued)

*Primary Examiner*—William M Pierce
(74) *Attorney, Agent, or Firm*—Calfee, Halter & Griswold LLP

(57) ABSTRACT

The present invention is a modified glove with control/grip-enhancing and perspiration retention properties, offering the bowler a range of functions and options specific to the individual bowler's abilities, equipment selection (i.e. bowling ball), and the lane conditions faced. An elastomeric, control/grip-enhancing material circumferences the fingertips of at least one finger, providing a similar shape and feel to the commonly used, cylindrical inserts/grips; the glove designed to be used in lieu of finger inserts. The present glove invention can be interchangeable between right and left-handed bowlers of approximately the same hand size. The perspiration retentive fabric combined with the elastomeric, control/grip-enhancing material eliminates or significantly reduces perspiration from an otherwise naked inserted finger, which normally has contact with the hole(s) of a bowling ball. Consequently, the present glove invention results in more consistent control and release of the ball off the hand, increased ball energy, increased ball motion and revolution potential, a higher impact between ball and pins, leading to more lively pin scattering, all of which ultimately results in higher scoring potential. Functionality and performance characteristics of various embodiments of the glove invention provide the bowler a range of control/grip-enhanced, textured and non-textured surface materials at the fingertip area of the glove. Likewise, the control/grip enhanced material of the palm area of the glove works to grip the surface of the bowling ball. The ball position in the cupped and gloved hand is maintained even though the bowler moves his/her hand slightly either away from towards or laterally with respect to the bowling ball. Embodiments of the glove invention offer the bowlers a variety of options for the fingers, as well as for support around the wrist area.

20 Claims, 10 Drawing Sheets

U.S. PATENT DOCUMENTS 2,949,610 A * 8/1960 Lutsky ..... 2/16
3,038,723 A * 6/1962 Bergendorf ..... 473/61
3,229,306 A * 1/1966 Bazar ..... 2/161.1
3,362,027 A 1/1968 Petrov
3,595,575 A 7/1971 Gooch
3,770,270 A * 11/1973 Ingold ..... 473/61
3,880,426 A * 4/1975 Morse ..... 473/61
4,781,178 A * 11/1988 Gordon ..... 602/22
4,881,275 A * 11/1989 Cazares et al. ..... 2/161.1
5,172,910 A * 12/1992 Ashurst ..... 473/61
5,447,490 A * 9/1995 Fula et al. ..... 601/40
D400,308 S * 10/1998 Paparella et al. ..... D29/114
D434,192 S * 11/2000 Warrior ..... D29/113
6,427,248 B1 8/2002 Albert
6,658,669 B1 12/2003 Addington
6,675,392 B2 1/2004 Albert

* cited by examiner (Palm-Side Up / R-Hand)

(2 Middle Fingers / R-Hand)

(Palm-Down / R-Hand)

(Elongated Embodiment - Palm-Side Up / R-Hand)

(Palm-Side Up / R-Hand)

(2 Middle Fingers / Left Hand)

(Elongated Embodiment
Palm-Side Up /
Cupped Position / L-Hand)

(Clamshell View of Glove– Palm Down)

(Elongated Embodiment – Back of Hand / R-Hand)

(Multiple Embodiments – Covered Fingertip View of Glove)

FUNCTIONAL CONTROL / GRIP-ENHANCED SPORTS GLOVE FOR BOWLING

This Non-Provisional Application claims priority to Provisional Application No. 60/661,417, filed on Mar. 14, 2005.

FIELD OF THE INVENTION

This invention relates to gloves worn on the hands, and more specifically, to gloves used in various activities, especially sporting activities such as bowling that are benefited by a grip-enhancing surface covering at least a portion of the palm and/or finger regions.

BACKGROUND OF THE INVENTION

The fundamental process behind the activity and game of "bowling" is for the bowler to insert the thumb and at least two (2) fingers of the bowling hand, usually the ring and middle fingers, into their respective holes of a bowling ball. With the fingers and thumb inserted, the basic objective is for the bowler to take a set number of steps on the approach with ball in hand, and with a pendulum-like swing of the bowling arm, release (i.e. roll) the bowling ball onto the 60'-long lane bed with the intent of knocking down as many of the 10 stationary bowling pins as possible that stand at the far end of the lane.

If any pins remain standing after the ball is rolled, the bowler is entitled to a second chance, going through the same process and routine of attempting to knock down any remaining pins left standing. If the bowler requires two chances to knock down all 10 pins, this equates to the completion of one (1) frame of bowling. An entire game consists of 10 frames. Each frame allows the bowler a maximum of two chances to knock down all 10 pins, with the exception of the $10^{th}$ frame, which offers the bowler a maximum of 3 chances, providing certain criteria are met under the specific rules and guidelines of the game of bowling.

In addition to physical and mental stamina, the ideal recipe for maximum scoring potential includes the following ingredients: 1) sufficient knowledge and understanding of the intricacies of the game of bowling, 2) possessing the proper bowling equipment (i.e. ball, shoes, accessories, etc.), possessing an awareness of the ever fluctuating lane conditions, as well as knowledge of when to employ which equipment and, 3) applying oneself through diligent and continuous practice in development of a proper and consistent ball release off the hand onto the ideal area of the lane, which is primarily dictated by lane oil conditions and target objective focused on.

In addition to possessing these three ingredients, common knowledge among most intermediate and advanced bowlers is that to consistently score the maximum number of pin count (i.e. number of pins felled), to a large degree, is dependent upon the time, manner and technique in which the bowling ball is released off the hand and fingers onto the lane. Primarily, the thumb and two middle fingers, which are inserted into the holes of a bowling ball have a significant bearing on the manner and release of 1) the ball off the hand, 2) stored ball energy, 3) ball motion, 4) ball rotation (i.e. axis and tilt), and, 5) ball revolutions as the ball travels down the lane toward its intended target.

Secondarily, the forefinger and pinky finger of the bowling hand, when firmly pressed against the exterior surface of the bowling ball, can positively impact ball motion, though the additional contribution is negligible at best. This complex motion imparted to and through the bowling ball by the aforementioned fingers and thumb of the bowling hand culminates at the time of ball release onto the lane, by what is known as "lift" or "spin". In bowling jargon, lift or spin is more commonly referred to as, imparting "revolutions" ("revs") to the bowling ball.

The role of the thumb does not have a significantly positive impact in generating "lift" during the ball release off the hand. Furthermore, an improper release of the thumb from its respective hole of a bowling ball, due to improper positioning and angle of the drilled thumb hole or, a thumb hole which is too tight or too loose, any of which will have an adverse impact on an otherwise properly released ball off the hand, thus preventing the ring and middles fingers of the bowling hand from imparting any meaningful lift or revs on the ball. Effective lift is primarily achieved when the thumb, in its correct position, cleanly exits from the thumb hole at the bottom of the downswing, and for a split second, allowing the ball to rest solely on those fingers inserted into the holes of the ball, usually, the two middle fingers, which remain in their respective finger holes, again, for just a split second longer than the thumb.

Revolutions (i.e. "revs") have a direct correlation to the bowling ball's axis rotation, tilt, spin and forward roll. This is referred to as the bowling ball's "shape" or "look" as the ball rolls or "travels" down the lane toward its intended target, the pins. The desired and ideal ball motion after the bowling ball has been released off the fingers onto the lane is a combination of what is commonly referred to as "skid", "hook" and "roll". In general, the more revs imparted to and through the bowling ball at the time of release, the more pronounced the scattering of pins (i.e. "pin action") at the point of impact between the ball and pins. Likewise, low or minimum revolutions imparted to and through a bowling ball at the time of release substantially reduce the bowler's scoring potential due to low rev rate and undesired ball roll. This results in what is referred to as a "weak hit" and consequently, ineffective scattering of the pins into one another. Thus, the more pronounced the scattering of pins into one another, the higher the chance of all 10 pins falling down on the first roll of the bowling ball, rewarding the bowler with what is called a "strike". The more strikes the bowler can accumulate in a 10-frame game, the higher the bowler's overall scoring potential becomes. Likewise, the accumulation of strikes simultaneously reduces the bowler's need for second chances at attempting to knock down any remaining pins standing in any given frame.

Few bowlers place their two middle fingers (i.e. ring and middle fingers) into the hard, natural, bored holes of a urethane, plastic or rubber bowling ball without the use of an accessory or aid inserted and secured against the interior wall of the finger holes of the bowling ball. A common bowling aid on the market used by the vast majority of bowlers possessing their own bowling ball(s) are referred to as "inserts" or "grips". Generally speaking, inserts are made from a soft, spongy, rubber-like material, such as silicone, PVC, vinyl, or polyurethane. Inserts, which come in a variety of colors, sizes, textures and interior diameters, are cylindrically shaped and snuggly fitted down into the finger holes of a bowling ball, affixed to the wall of the pre-drilled holes by the use of an epoxy or super glue type of adhesive. Inserts accommodate a wide range of finger sizes and texture preferences of bowlers. However, generally speaking, though the interior diameter and texture of inserts can vary widely, the exterior diameter of the majority of all inserts, regardless of brand or maker, are the exact same exterior diameter, which is $^{31}/_{32}$". This convenient feature accommodates and benefits all bowling pro shop operators around the world.

For the majority of bowlers that use inserts or grips, this means that the pro shop operator need only reach for a 31/32" drill bit to bore the finger holes of a bowing ball to accommodate the inserts . . . regardless of brand, texture, or the finger diameter or size of the bowler employing the grips. The pro shop operator merely pre-drills the finger holes to a depth of approximately 11/8" to 13/8" to accommodate industry standardized inserts. When the inserted fingers, usually the two middle fingers of the bowling hand and, more specifically, the pads of these middle fingers are placed in the finger holes of the ball, that is, placed inside the opening of the adhered inserts (i.e. grips) and, pressed against the inside walls of the inserts themselves, the inserts offer the fingertip(s) or pad(s) of the finger(s) a comfortable and soft, spongy, rubbery feel due to their vinyl-like properties. Under ideal conditions, inserts can provide the bowler increased ball control at the point of ball release, reducing the chances of the ball "slipping" off the bowler's hand, as the ball, fingers, hand and arm move in unison throughout the complete pendulum swing of the bowling arm. However, it is important to stress that due to natural perspiration secretion around the finger pads of the inserted fingers and, the resultant accumulation and build-up of this perspiration residue which transfers to the inside walls of the inserts, the propensity for slippage of the bowling ball off the bowling hand becomes significantly more pronounced at the completion of the pendulum swing, at the point of release, when the bowler attempts to "lift" the ball off the inserted middle fingers onto the lane. The negative impact of perspiration secretion of the inserted bowling fingers is as much of an issue and detriment to bowlers that do not use any sort of insert or grip aid in their finger holes of a bowling ball as to those bowlers that do. In the case of those few bowlers that place their fingers into the naturally bored out holes of a bowling ball, the perspiration build-up is merely transferred against the interior walls of the finger holes of the ball material itself. This lack of control of the bowling ball off the fingers is commonly referred to as "losing the shot". Likewise, loss of control of the bowling ball at point of release can be further exacerbated by an improperly fitted thumb, resulting in the thumb "hanging-up" or "slipping out" of the bowling ball at point of release of the ball onto the lane.

Losing the shot due to perspiration secretion around the fingertips of those fingers inserted into the holes of a bowling ball can be triggered and attributed to a variety of causes, such as stress, increased anxiety, tension and excitement, and humidity. Signs of a bowler losing the shot can be seen and, often heard immediately after the ball is released (i.e. "slips") from the bowling hand onto the lane. This is also often times referred to as 'dropping the ball' onto the lane.

Losing the shot or dropping the ball onto the lane bed often results in the ball making a loud "thud" as it is dropped onto the lane, instead of the bowling ball rolling smoothly and silently "into" the lane, similar to an airplane landing on a runway. Another sign of losing the shot is when the bowling ball bounces onto the front of the lane, just past the foul line, immediately after the ball slips off of the hand upon the completion of the pendulum swing. This unintentional "bouncing" of the bowling ball onto the lane is sometimes referred to as "double-dribbling" the ball. Either scenario is detrimental to achieving maximum ball revolutions and consequently, maximum pin count. The ball's stored energy level, and rev potential is severely diminished. As a result, this marginalizes the ball's inertia and chances of reaching its intended target with any meaningful revolutions, energy, and impact. This ultimately and negatively impacts pin action and has an adverse effect in achieving maximum scoring potential.

Perspiration secretion of the bowling hand and more specifically, around the inserted bowling fingers is normal and will occur. In the course of a bowling game or competition, it is not a matter of if perspiration will become an issue, but merely when will it become an issue. As perspiration becomes an issue, to prevent losing the shot, the undesired, yet normal and natural bodily reflex of the bowler is to unconsciously or sometimes consciously, "squeeze", "grab", "grip" "pinch" or "choke" the bowling ball with the thumb, and those fingers inserted into the finger holes of the ball. This negative response of the bowler to perspiration will either commence while in the set position on the lane approach or, soon after the bowler begins his/her movement toward the foul line with simultaneous and coordinated movement of the bowling ball during the pendulum swing of the bowling arm. Squeezing of the bowling ball will usually occur immediately after the bowler pushes away the bowling ball into the initial downswing, continuing through the back swing and back again through the down swing until point of release of the ball onto the lane. Grabbing, gripping, pinching, squeezing or choking of a bowling ball automatically tenses up the wrist, forearm and bicep of the bowling arm, preventing a fluid and relaxed movement and swing of the bowling arm. Ideally, the bowling ball should be held like an "egg" throughout the pendulum arm swing. The fluid movement of the bowling arm is a critical and fundamental principal behind the ideal release of the bowling ball off the hand, more specifically, off of the inserted middle fingers. This is crucial in achieving the desired ball revolutions, which ultimately impacts scoring potential.

The use of inserts can reduce the need to squeeze the bowling ball and can add a measure of control during the pendulum swing, especially at the release point. However, inserts neither completely eliminate the undesirable habit of squeezing nor do inserts directly address or overcome the inevitable dilemma of perspiration around those fingers inserted into the finger holes. Nevertheless, most bowlers view inserts as so critical an item to the game of bowling, that the need for inserts is reduced to a mere afterthought at best, with the bowler merely entertaining which color or "textured" insert is desired for use. It would not be an exaggeration to state that inserts are almost as important as the bowling ball itself, without which, many bowlers psychologically could not perform to their maximum potential; at least, not with their middle fingers inserted into the naked, bored out holes of a bowling ball.

Under optimum conditions, a bowling ball must be rolled into the ideal area of the lane to make contact at the ideal area of the pins to gain maximum scattering of the pins and pin fall. This ideal area is known as the "sweet spot" or "pocket", which is between the #1 and #2 pin for a left-hander or between the #1 and #3 pin for a right-hander. Thus, the bowler must possess 1) the right bowling equipment, 2) ample understanding and knowledge of the intricacies of the game of bowling to make a proper and timely equipment adjustment during the game and, the bowler must 3) dedicate time to practice and hone the bowling skills necessary, applying equipment and knowledge in a practical manner. Nevertheless, even if a bowler possesses all of the above attributes, there still remains an important requirement and element to the game of bowling in order to achieve maximum scoring potential. As the ultimate objective is to consistently achieve as many strikes as possible, resulting in high scoring potential, first and foremost, the bowler must be able to hold onto the bowling ball long enough to properly release (i.e. lift) the bowling ball onto the lane, with a fluid, loose, pendulum-like arm swing, not a tense arm swing, which results from squeezing the ball. A proper and ideal release results in the appropriate amount of stored energy imparted to and through the ball, as well as, the ideal combination of revs, axis rotation, tilt, and ball speed (achieving a skid, hook and roll ball motion). The ideal outcome will be that the bowling ball will reach its intended target 60' away with the ideal ball speed and ball motion. And, as the accumulation of strikes in a game results in a higher scoring potential, consistently hitting the pocket at the ideal angle of entry with the desired impact, will result in maximum pin action and, ideally, the bowler will be rewarded with a strike.

This process is much more complex and difficult to achieve on a consistent basis than it appears on the surface, due in large part to perspiration which surfaces on and around the thumb and pads of the inserted fingers, usually the ring and middle fingers of the bowling hand. As the number of revs generated to a bowling ball will vary from one bowler to the next, perspiration is a constant adversary of most all bowlers and can be extremely detrimental to the bowler whose natural skills and physical ability at generating revs is already limited, even under the most ideal circumstances. Regardless of skill level, perspiration of the bowling hand, meaning the thumb and more specifically, the inserted fingers is usually the nemesis of even the best bowlers in the world. This is due to the snug, tight fit of the inserted fingers necessary in order for the inserted fingers to impart maximum revs to the bowling ball at the release point. The dilemma of the natural secretion of perspiration is further amplified, usually at the most inopportune time, and especially when anxiety is present, such as during league or tournament competition. Perspiration, especially around the finger pads of the ring and middle fingers of the bowling hand can quickly play havoc with the bowler's ability to impart lift to the bowling ball at time of release, which is critical to achieving adequate ball revolutions, maximum pin scattering, and ultimately, high scoring. Though inserts can offer the bowler increased control of the bowling ball, unless kept in check, perspiration will naturally accumulate very quickly against the interior surface of the insert itself, especially where the inserted finger pads of the bowling hand makes flush contact against the walls of the inserts. Perspiration build-up against the walls of the inserts immediately results in a slippery, uncontrolled feeling when attempting to hold the bowling ball without squeezing. This in turn, renders inserts completely inadequate and ineffective unless the bowler addictively relies upon quick fix, temporary perspiration-retention ointments, powders, towels, etc. constantly applied to the bowling hand throughout the bowling game(s). The bowler is thus required to dedicate continuous and deliberate attention to curb the adverse and detrimental effect perspiration will have in preventing the bowler from achieving a clean ball release off the hand; and instead forcing the bowler to grab or squeeze the ball.

In attempts to arrest the problem of perspiration, the bowler can choose to use one or more of the bowling accessories and aids available on the market, specifically designed to temporarily offset perspiration and/or provide a momentary measure of tackiness to the bowling hand and/or fingers. These include a vast array of products, such as bowling tape, powders, creams, rosin bags, puffballs and hand towels.

In addition to investing in one or more of these product alternatives into their game and, in an effort to stave off the negative impact and effect perspiration of the hand and fingers can have on maximizing scoring potential, most bowlers as a matter of habit and routine, either blow air directly into the thumb and/or finger holes of the bowling ball or place their bowling hand over the air blower just prior to stepping on the approach and prior to placing their thumb and middle fingers into the 3 holes of the bowling ball. An "air blower/air dryer" is located at the end of each ball return rack, which can be found on the approach of most lanes. On a pair of lanes, the ball-return rack divides the left lane from the right lane and is the device, which the balls can be seen resting on until it is the bowler's turn to bowl. Regardless of the perspiration product and/or method chosen to combat perspiration, all are merely temporary treatments that the bowler must religiously and consistently employ throughout the activity of bowling, lest the bowler risk losing a shot, resulting in minimum stored energy imparted through the ball at point of release off the hand, undesirable ball motion down the lane, less than desirable pin count and ultimately, lower scoring potential.

Other options available on the market today for bowlers are a variety of bowling gloves and "bionic arms" that tout better control of the bowling ball, as well as, increased rev potential, which implies increased scoring potential. "Bionic arms" are merely metal devices, which cover a certain portion of the hand and wrist area, leaving all fingers and thumb exposed to the elements. Their primary function in general is to provide rigid wrist support, while simultaneously allowing the bowler to manually adjust the device on the hand to contort the bowling hand and wrist into a desired position and/or angle, which will impact the manner in which the ball departs off of the hand onto the lanes, affecting the ball's axis tilt, rotation and revolutions. These bionic arms do not cover any of the fingers or thumb, but rather, leaves them exposed to the elements. On the other hand, bowling "gloves" are primarily meant to cover the palm, forefinger and pinky finger of the bowling hand and, in some cases provides support to the wrist. Excellent examples of the flawed thought processes and shortcomings behind bowling gloves can be immediately and visually recognized in the complacent, sameness of existing gloves designed for bowling. Many bowling gloves incorporate a frictional, gripping material on the palm area that has direct contact with the surface of a bowling ball. This frictional, gripping effect on the palm area of a glove helps balance the ball while the bowler cradles it in both hands during the set position on the approach.

All bowling gloves of today are designed to completely cover only two fingers, specifically, the index finger (i.e. forefinger) and pinky finger (i.e. little finger) with a truncated and protruded ring finger, middle finger, and thumb portion. The material used in the design and build of a bowling glove usually incorporates a leather or leather-like material, similar to the material used in golf gloves, which provides a measure of gripping surface of the covered index finger and covered pinky finger. As for the truncated ring and middle finger portions, all existing bowling gloves of today only extend up to the first knuckle of the these particular fingers, with the balance of these two middle fingers (ring and middle fingers) protruding through the glove, exposed to the natural elements. The thumb portion of existing bowling gloves typically extends only up to the base knuckle of the thumb, allowing the thumb to protrude in its entirety, exposed to the natural elements, resembling the exposed and protruding two middle fingers of the bowling hand. The presumption behind existing bowling glove designs that exposes the thumb and the two middle fingers, focusing attention solely on the covered forefinger and pinky is that by pressing the covered forefinger and/or pinky finger of the bowling hand very firmly against the exterior surface of a bowling ball, there is the potential of an increase in ball revolutions at point of release off the hand, due to the tactile, frictional material which covers these two fingers. However, the impact and degree of rev increase is negligible at best, even at the advanced level of bowling. Furthermore, a grip-like material on the forefinger and/or pinky finger aids marginally in control of the exterior surface of the bowling ball while cradled, cupped in or against the palm of the bowling hand. By and large, focusing attention exclusively on the role of the forefinger and pinky finger of the bowling hand, the effect and result these two fingers have at the release point of the ball off the hand, concluding with the contact of ball and pins is at best marginal.

Bowling balls are designed for use with normally three (3) drilled holes; one hole for the thumb and two holes drilled to receive the two middle fingers of the bowling hand, specifically the ring and middle fingers. Consequently, it is evident to even non-bowling enthusiasts that any fingers inserted into the accommodating finger holes of a bowling ball, with or without the aid of inserts, have significantly more of a direct cause and effect relationship and impact with respect to holding, controlling, and releasing of the bowling ball onto the lane, as well as, affecting ball axis tilt and rotation, in addition to, imparting any meaningful energy and revolutions to and through the bowling ball, than any fingers placed against the exterior surface of a bowling ball itself; in this case, the forefinger and pinky finger, whose combined primary function is to serve as an expanded base in which to balance the ball mostly in the cup of the palm of the bowling hand.

SUMMARY OF THE INVENTION

It is with the above shortcomings in mind that the instant glove invention was developed, which primarily, though not exclusively, concentrates attention fittingly on any fingers inserted into the finger holes of a bowling ball, which usually include, though are not limited to the ring and middle fingers, otherwise referred to as the "two middle fingers". It is recognized and acknowledged that not all individuals possess five digits (four fingers+thumb) on each hand and consequently, may not possess necessarily any "middle fingers" per se. Nevertheless, for those that do not possess their own personal bowling ball(s), the vast majority of bowling establishment owner/proprietors around the world provide their bowler patrons a service, that is, free access to "house balls", that is, bowling balls of various weights and drill patterns that belong to the bowling establishment for use in the activity of bowling. The vast majority of house balls, which are found on readily accessible "ball racks/stands" throughout the bowling establishment are normally pre-drilled with three holes. One hole accommodates the thumb and two additional pre-drilled holes, drilled in a direct line across from this thumb hole (and not offset at a right or left angle away from the thumb) are meant to comfortably accommodate the two middle fingers of the bowling hand; not for the accommodation of placing whichever of the four fingers of the hand the bowler chooses. Therefore, it can be deduced that the vast majority of those that participate in the activity and sport of bowling, whether on a recreational or competitive level, use the two middle fingers, that is to say, the ring and middle fingers of the bowling hand to assist the thumb in holding and rolling a bowling ball down the lane. It is with this understanding in mind that the term and descriptive "middle fingers" is used throughout this instant glove invention. Likewise and secondarily, attention is given in this instant glove invention to the other two fingers, that is to say, those fingers that are normally not inserted into any holes of the ball, but rather are placed on the exterior surface of a bowling ball, specifically, the forefinger and pinky finger. Additionally, this instant glove invention gives attention to the wrist area of the bowling hand in one embodiment.

As shown herein, this invention according to the inventive principles disclosed, in one embodiment comprises an interchangeable, modified glove that can be worn by both left-handed and right-handed bowlers alike, possessing approximately the same hand size, span and finger length.

Interchangeability between right and left-handed bowlers is a feature and advantage of this glove offered in one embodiment of the present invention, not demonstrated in any previous prior art. In one example, the glove is placed on the (inserted) ring and middle fingers of the bowling hand, which also has not been demonstrated in any previous prior art. These two middle fingers are principally responsible for holding and controlling the bowling ball throughout the pendulum arm swing, as well as, affecting and impacting axis tilt, rotation and generating revolutions to and through the bowling ball, all of which ultimately impacts scoring potential. The present glove invention according to one embodiment directs attention to address maximizing ball revolution and scoring potential by targeting a source of perspiration itself, which are those fingers inserted into a bowling ball, chiefly, though not limited to the ring and middle fingers of the bowling hand. There is a cause and effect relationship with ball motion and scoring potential as it pertains to these two inserted middle fingers. Regardless if perspiration aids are employed to tackle perspiration, the degree of perspiration on the bowling hand and fingers, in addition to perspiration residue and build-up along the inside of the ball holes themselves or walls of inserts if they are used, will be proportional to the importance and attention the bowler places on it (i.e. perspiration).

The nemesis of perspiration, resulting in reduced ball control and inconsistent or ineffective ball revolution is usually blamed on the two middle fingers inserted into the bowling ball. The use of inserts as an aid offers the bowler a temporary yet inconsistent and flawed remedy to increasing ball control and revolutions. Assuming the bowling ball reaches its intended target, ball revolutions have a direct correlation to pin scatter and ultimately, pin count. In general, irrespective of whether inserts are used, the amount of ball revolutions imparted to and through a bowling ball is influenced by the manner in which the ball is released off of those fingers placed in the finger holes of the ball (i.e. finger pads of the ring and middle fingers). If inserts were a genuine solution to increased ball control and increased revolution potential, the need for perspiration-retention products would be redundant and thus, unnecessary. On the contrary, inserts have been demonstrated in fact not to be a solution to perspiration, which perspiration has a direct and detrimental effect on ball control, ball revolutions, roll consistency and ultimately, scoring potential.

The vast majority of all bowling balls, whether "house balls" or personally owned balls are drilled with 3 holes. In general, two holes accommodate the two middle fingers (i.e. ring and middle fingers) and one hole, which is usually drilled in a somewhat direct line away from these two finger holes, is reserved for the thumb. As has been revealed, inserts in general, regardless of brand, possess the same exterior diameter ($^{31}/_{32}$"). As the majority of bowlers possessing their own bowling ball(s) secure inserts in the two drilled finger holes, with the exception of a $^{29}/_{32}$"-sized insert, all holes bored into a bowling ball to accommodate finger inserts are automatically drilled with a $^{31}/_{32}$" drill bit. Regardless of the brand of inserts used by bowlers, though the interior diameter and texture of inserts are numerous, the exterior circumference of inserts is of a standard size throughout the bowling industry. This is why the use of inserts requires the person drilling the ball (i.e. pro shop operator) to hollow out the finger holes of the ball by means of a $^{31}/_{32}$" drill bit. It should be noted that although typical dimensions are provided herein, the present invention is not limited to such dimensions and variations and, variations in dimensions are contemplated as falling within the scope of the invention. Thus, prior to boring the finger holes of a bowling ball, the pro shop operator will typically first ascertain if the bowler will use inserts. In the rare case that a bowler does not use inserts, the pro shop operator will likely custom drill the finger holes to match up to the individual's finger size(s), which means that the two holes will likely be of different sizes, as the ring and middle finger are normally anatomically different. However, if inserts are used, as is normally the case, the pro shop operator will typically set up the drill press to accept a 31/32" drill bit to bore any hole that an insert will be secured to the inside. This generally remains a constant and for the most part, irrespective of the actual finger size of a bowler. Even though the two middle fingers are normally anatomically different, the interior diameter of an insert and not the exterior of an insert address this area. The interior diameter of an insert and not the size of the finger hole itself is designed to match up to a bowler's anatomical finger size and individual comfort requirements. The outside of the insert is not a factor due to the fact that a 31/32" cavity is significantly larger in circumference than most any person's finger circumference. As for the thumb, given the location and placement of the thumbhole, as well as the role the thumb plays in relation to any inserted fingers (i.e. ring and middle fingers), the thumbhole is measured and custom drilled for each bowler.

The design and functionality of the present glove according to one embodiment of the invention takes inserts out of the equation. Attention is focused instead and, more appropriately, on a glove design that is interchangeable and incorporates distinctive features allowing the bowler to secure over the hand and at least the two middle fingers of the right or left hand, the present glove invention. The gloved hand and more specifically, the gloved fingers are then placed snugly into the bare 31/32" drilled finger holes of a bowing ball. This snug, elastic and supple feeling of the glove around the fingertip area of the covered fingers provide the bowler with both the sensation and performance characteristics inserts provide, while simultaneously eliminating the detrimental effects perspiration has on control, release of and applying revolutions to and through the bowling ball, which inserts do not provide nor are they meant to address. This is the role of perspiration-retention products. In one embodiment, components of the present glove invention are not limited to, but address at least the two middle fingers of the bowling hand, the palm, back side of the hand and, in various embodiments, including an elongated embodiment of the present invention, the wrist area. The present glove invention in one embodiment becomes interchangeable when addressing the two middle fingers of either the left or right hand from the fingertips down to the knuckle area at the base of the hand, with a part of the glove covering a portion of the palm, back side of the hand and, in the elongated embodiment, the wrist area.

Surrounding the fingertips of at least the two middle fingers is an elastomeric, control/grip-enhanced, abrasion-resistant material, which may be used alone or in combination with neoprene, a coated or laminated fabric or, a similar material. Excellent examples of such tactile materials possessing control/grip-enhancing and abrasion-resistant properties are typically found in various types of urethane, PVC, polyurethane, vinyl, rubber and silicone-rubber compounds and substrates, however, any suitable material is contemplated by the present invention. This control/grip-enhanced, elastomeric material is cylindrically shaped, in one embodiment, to contour around the tips of the fingers either directly or in combination with neoprene, a coated or laminated fabric and/or a similar material, sized to fit snugly into the bare 31/32" drilled finger holes of a bowling ball, providing the bowler with the feeling, as well as performance characteristics comparable to inserts. Additionally, the elastomericity, range and thickness/thinness properties of the control/grip-enhanced material used alone or in combination with neoprene, a coated or laminated fabric or, a similar material also possessing various thickness/thinness properties, allow for various embodiments of the present glove invention, especially around the covered fingertips to fit snugly in drilled finger holes of sizes other than 31/32". Therefore, it is to be understood that the material surrounding and covering the fingertip area of at least the two middle fingers can be fabricated to any desired length, thickness or diameter and, with various surface textures to meet bowler's demands. In one embodiment, the elastomeric, grip-enhanced material either used alone or in combination with neoprene, a coated or laminated fabric and/or a similar material may provide a predetermined level of compressibility and deformability to provide a snug, yet comfortable, secure reception of a bowler's fingertips without the risk of the bowler "sticking" or "hanging-up" in the finger holes of the bowling ball upon release of the ball unto the lane.

In one embodiment, attached to this abrasive-resistant, control/grip-enhanced, material which surrounds the fingertip region, extending down and covering at least the two middle fingers to about the base knuckle of the hand is a thin, smooth, abrasion-resistant, extremely durable, 4-way stretch, moisture-retention, yet breathable fabric, possessing excellent stretch and recoverability properties. It is a feature of one embodiment of the present glove invention that this combination of an elastomeric, control/grip-enhanced material(s) around the fingertips used alone or in conjunction with neoprene, a coated or laminated fabric or, neoprene-like material and, said 4-way stretch fabric covering the balance of at least the two middle fingers, finally contains and prevents the natural secretion of perspiration around the covered fingers, more specifically, the finger tip or finger pad area of any inserted fingers from coming into contact with the interior walls of the finger holes of a bowling ball. Perspiration secretion of any inserted, gloved fingers is at last, prevented from having direct contact with any surface outside of that area of the glove itself, such as the hollowed walls of the finger holes of a bowling ball or the walls of finger inserts (i.e. "grips") if used. The resulting effect in the design and functionality of the present glove invention is that the glove will facilitate the bowler to significantly increase ball control, especially with respect to the relationship between the ball and the inserted two middle fingers. Furthermore, there is an immediate and considerable enhancement in the bowler's ability and potential in consistently applying maximum revs to and through the bowling ball off the gloved, inserted fingers, usually the two middle fingers and, more specifically, the fingertips, which become critical at the point of release of the ball off the hand onto the lane. This enhancement ultimately increases the bowler's scoring potential as the number of ball revolutions is directly related to pin scatter at point of impact of ball and pins, as the pins scatter and ricochet off of one another, as well as ricocheting off the sideboards and the kickback, both located at the end of the lane bed in what is called the "pit area".

Additionally, embodiment(s) of the present glove invention comprises the forefinger and/or pinky finger, and are designed to include a similar breathable fabric and, grip-enhanced material along the underside or pad side of these fingers. When either or both these two fingers are covered with the fabric and, control/grip-enhanced material along the underside of these fingers, perspiration will be prevented from coming into contact with the exterior surface of the ball.

Likewise, the control/grip-enhanced material along the underside of the forefinger and pinky finger will simultaneously provide the bowler with an additional measure of gripped feeling and control of the exterior of the bowling ball while the ball is cupped or cradled with the bowling hand.

Left on its own, the eventual secretion of perspiration along any uncovered finger pad areas of any fingers placed either into the bare finger holes of a bowling ball or placed inside inserts if used, will eventually and quickly result in the deteriorating, slippery and uncontrolled grasp of the bowling ball. Any uncovered, inserted fingers will naturally be prone to slip out of their respective ball holes, causing the ball to prematurely separate from the hand, resulting in less than optimum ball energy, ball revs and ball motion. The combination of the moisture-retention, breathable, 4-way stretch fabric enveloping any covered and inserted fingers, along with a control/grip-enhanced material used alone or in combination with neoprene, a coated or laminated fabric or, a similar material will assist the bowler in combating and reversing any negative habits consciously or unconsciously developed with respect to squeezing or "choking" the bowling ball in the hand at any point during the pendulum arm swing or release point of the bowling ball off the inserted fingers onto the lane. As the dilemma of perspiration around the fingertip area is eradicated or reduced, the present glove invention enables the bowler to consistently hold, control and release the bowling ball onto the lane with maximum "lift" and, without premature slippage of the bowling ball off the hand and more specifically, the gloved, inserted fingers. As a result, the frictional properties of the control/grip enhancing material against the walls of the finger holes of the ball allow the bowler to repeatedly and consistently impart maximum revs and energy to and through the ball in relation to the bowler's optimum level and abilities.

When worn, the present glove invention provides the bowler with an increased level of repeatability at achieving increased rev potential with each shot that he/she would otherwise be unable to realize or replicate on a consistent and continuous basis under the limitations of the bowlers' natural abilities and, due to the ever-present dilemma of perspiration, which is a natural, yet undesired ingredient of the activity and sport of bowling.

It is further among the goals of the present glove invention, that the control/grip-enhanced material surrounding at least the two middle fingers be made in a variety of resilient elastomers, such as but not limited to, urethane, PVC, polyurethane, silicone, vinyl, various rubber compounds (or other useful alternatives, known, or not yet developed); either alone or in combination with such other complimentary materials, such as neoprene, coated or laminated fabric or, a similar material; the variety of elastomers and neoprene or similar neoprene-like materials to be used in various geometric distributions, and in various levels of thickness and hardness in order to provide the bowler optimum ball release off the hand.

Each individual, resilient, elastomer in the acceptable range of hardness, softness and textural surface patterns has a related individual coefficient of friction. Choosing the correct durometer hardness and coefficient of friction values and properties of the control/grip-enhanced material incorporated around the fingertip area and, to a lesser degree, on the palm area of the glove, will substantially increases the bowler's competitiveness and ability to produce a range of frictional and extraction speeds of ball release off the hand, specifically, off any gloved, inserted fingers, with less force and effort. Rev rates vary from one bowler to the next. Factoring in the lane conditions (i.e. extremely oily→extremely dry), the correct equipment selection (i.e. ball choice) and a bowler's normal rev rate, without use of the present glove invention, the bowler will now be able to assess and identify the correct frictional, grip-enhanced, textured properties along the fingertip area of the present glove invention or any of its embodiments that best matches up to the lane environment, ball selection, rev rate and ball roll sought to overcome the lane oil conditions faced, to create the optimum scoring potential possible.

Eradicating the problem of secreted perspiration of the fingertips from contacting part of the interior wall of the finger hole of a bowling ball is valuable. Likewise, offering the bowler a substantial increase in control and manipulation of the bowling ball at time of release is advantageous. In one embodiment, the present glove invention simultaneously offers the bowler both features. As the bowler possesses the freedom and opportunity to evaluate and analyze the current situation (i.e. lane condition), the bowler, with the aid of the present glove invention, is now free from worry and distraction that perspiration has in negatively affecting both the bowler's mental and physical game. Instead, the present glove invention now affords the bowler with the ability to clearly focus on the shot and hand, providing the bowler with a consistent opportunity to deliberately alter ball rev rate potential up or down, in addition to the capability of making high quality adjustments to achieve the desired ball axis tilt, rotation and ball roll at the critical point of ball release off the hand onto the lane, without perspiration on the bowling hand and at least the inserted two middle fingers negatively affecting or impacting the bowler's ability to achieve his/her desired results. In one embodiment, the present glove invention affords the bowler the ability to intelligently make tactical and timely equipment adjustments that ultimately and positively impacts the bowler's scoring potential even under the most challenging and demanding lane conditions faced. No other existing glove or existing prior art offers these features to the bowler.

The fingertip areas of at least the two middle fingers of the present glove invention are preferably formed of several types of elastomers, which may or may not be used in conjunction with materials such as neoprene, coated or laminated fabric or, similar material. Multiple forms of the elastomers may at times be used in different embodiments of the same glove invention. The different thickness-thinness, hardness-softness characteristics and frictional properties of the various elastomers, may be used in conjunction with materials such as neoprene, coated or laminated fabric or, a neoprene-like material, also possessing different thickness-thinness properties. The elastomers selected to be used singularly or in combination with one another or possibly in combination with materials such as neoprene, coated or laminated fabric or, a similar material, permits the present glove invention or a variety of embodiments of the glove invention to be used snugly, seamlessly and effortlessly in an industry-standard 31/32" bored finger hole drilling, as well as, hole sizes other than an industry-standard 31/32" bored finger hole drilling. In one embodiment, the present glove invention allows bowlers to do away with their existing and ineffective inserts, replacing inserts with the more effective present glove invention. Likewise, in additional embodiments, expanding thickness-thinness parameters of the cylindrically-shaped, control/grip-enhanced material and/or materials such as neoprene, coated or laminated fabric or, a similar material, either in combination or separately surrounding the fingertip areas of at least the two middle fingers, allows the bowler to use various embodiments of the present glove invention with exotic, experimental drill patterns, such as is envisioned with spherically smaller finger holes bored in the ball to alter ball revolution potential and ball motion. Or, in which can be envisioned and used in an embodiment of the present glove invention designed to fit smaller-sized fingers, such as can be found with very small children and adolescents who also participate in the sport and activity of bowling and, who also are not immune to the challenges of holding and rolling a ball down the lane with any consistency, especially when addressing the issue of perspiration of the bowling hand and any fingers inserted in and used to hold a bowling ball.

A glove embodiment of the present glove invention would afford a small child or adolescent the ability to grasp, hold onto and roll a bowling ball that would otherwise be difficult to hold due to the finger holes of a house ball being too large of a diameter or, due to a house ball being a bit too heavy for a child or adolescent to hold onto with any control without the aid of the present glove invention.

An additional feature according to one embodiment of the present glove invention is the significant reduction in wear and tear on the two glove-covered, inserted middle fingers. Cylindrical inserts oftentimes injures, inflames or puts extreme wear and tear on or around the finger nail area and/or sometimes "burn marks" on the pads of the naked, inserted two middle fingers at the fingertip and finger pad area through the direct, violent and frictional rubbing of the inserted fingers against the walls of the inserts as the inserted fingers attempt to apply maximum revolutional force to and through the ball at point of ball release off the hand and inserted fingers. However, in one embodiment, the present glove invention significantly reduces the chance of injury and wear and tear to the two middle fingers. The glove itself, specifically, the control/grip-enhanced surface, interiorly and, the exterior control/grip-enhanced surface surrounding the fingertips and finger pads of the two middle fingers has frictional contact against the interior walls of the finger holes of the bowling ball at point of release, and not the fingers themselves. The two middle fingers are substantially stabilized, immobile, protected and encased inside the finger sleeves, which provide the bowler a snug, soft and spongy control/grip-enhanced material at the fingertip area of the glove, very similar to the feeling offered by the less effective, injury-prone inserts/grips. Hence, as a result of minimal movement of the two middle fingers snugly secured inside the glove finger sleeve area and, more specifically, the control/grip-material of the glove surrounding the two middle fingertips, which are responsible for applying the direct, frictional revolutional energy and force to and through the ball, the likelihood of inflammation around the fingernail areas of the inserted fingers, "burn" marks and/or other common bowling-related injuries to the bare fingertips, finger pads and/or the edges around the fingernails, injuries and damage resulting from the violent, frictional rubbing of the inserted two middle fingers against either the bare walls of the finger holes of a bowling ball or against the interior walls of inserts/grips if used, is drastically diminished. This consequently affords the bowler the increased likelihood of pain-free bowling, which will positively impact the bowler's scoring potential, bowling longevity, and consequently, appreciably enhancing the bowler's overall bowling experience, whether on a competitive or recreational level.

Another feature of the present glove invention according to one embodiment is that the palm area of the glove also comprises a control/grip-enhanced material, which is attached and partly overlaid the edge of the fabric, which extends down from the covered fingers. The control/grip-enhanced material on the palm of the glove is intended to come into contact with the exterior surface of a bowling ball by friction force. In the palm-up position, while cradling the ball in the cup of the hand, this additional grip material on the palm area of the present glove invention allows the bowler to maintain contact with and control of the bowling ball even though the bowler moves his/her hand slightly either away from, towards, or laterally with respect to the bowling ball. Furthermore, this control/grip-enhanced material on the palm area of the present glove invention offers the bowler the flexibility and control of rolling the wrist over or back (clockwise or counterclockwise), rotating the wrist up or down or tilted from left to right, depending on the amount of axis tilt, rotation and ball motion the desired or required at the point of release. The control/grip-enhanced material in one embodiment also cushions the bowling ball in the bowler's hand while in the cradle or cupped position, in addition to preventing perspiration around the palm area of the hand from coming into contact against the exterior surface of the bowling ball.

For those bowlers that require wrist support, which limits the parameters of wrist rotational movement, an elongated embodiment of the present glove invention offers the bowler an additional feature of an attached wrist support tension strap, which secures over the glove around the base of the bowler's wrist area, holding both the glove and bowler's wrist in place via a hook and loop-type closure system, secured with a material such as VELCRO®. A good example of such a hook and loop clasp is sold under the trademark VELCRO®, however, other mechanisms may be employed and are contemplated as falling within the scope of the present invention.

To place and secure the present glove invention to the hand in one embodiment, the glove is opened and placed over the hand and fingers in a sandwich or clam-like manner, covering at least the two middle fingers, the palm, back of the hand, and, in one of its elongated embodiments, the wrist area. The sandwich-like glove is secured to the hand with an adjustable tension strap located all the way around the approximate middle of the hand. In an elongated embodiment, an additional, adjustable tension strap secures the glove in place over the wrist area while providing support to the wrist.

Thus, another feature of the present glove invention according to one embodiment is an adjustable tension strap, also made of an elastic, tactile control/grip-enhanced material. The strap is wrapped approximately around the center of the hand from the palm area and continuing over and around approximately the center of the back of the hand between the knuckles of the hand and the base of the wrist.

In one embodiment, as the present glove invention is interchangeable for use by either left or right-handed bowlers, an additional feature of the present glove invention related to the strap is that as this strap is removable, the strap could conceivably be wrapped from front to back or from back to front and, secured anywhere along or around the circumference of the center of the hand, depending on the user's preference and ease of securing the present glove invention to the bowling hand. Whichever method is used for wrapping the strap around the glove, the strap is secured to itself with a hook and loop-type closure system; secured with a material such as VELCRO®. A good example of such a hook and loop clasp is sold under the trademark VELCRO®. In one embodiment, this strap is interlaced and joined via at least two (2) incisioned slits on the palm area of the glove. The slits serve three (3) purposes. First, the slits allow the bowler to adjust, position and secure the strap around the center of the hand where it feels most comfortable to the individual bowler, and not uncomfortably pinching the bowler's hand, especially around the tendon area connecting the thumb to the forefinger (i.e. fold of the hand) and, around the "knife edge" of the hand, which is to say, the meaty area running along the side of the pinky finger. Second, the incisioned slits allow the bowler to "tug" on the glove if necessary, making minor adjustments to the glove position on the hand to maintain a consistent feeling around the covered fingertip area, without disturbing the position of the tension strap from where the strap had been originally secured around the center of the bowler's hand. Third, as the present glove invention is interchangeable, able to be worn by either left or right-handed bowlers, the slits allow the bowler the option and personal preference to take this detachable tension strap and to intertwine and reposition the strap with the hook and loop closure system on either the left or right side of the hand.

In view of the foregoing, other aspects, features, and details of the present glove invention can be more completely understood by reference to the following descriptions in conjunction with the drawings and from the appended claims. Although the foregoing includes a description of one or more examples for carrying out the invention, various modifications are conceivable.

As various modifications could be made in the construction of the present glove invention herein described and illustrated without departing or deviating from the scope and fair meaning of the invention and the subjoined claims, it is intended that all matter contained in the foregoing description or shown in the accompanying drawings shall be interpreted as illustrative rather than limiting.

BRIEF DESCRIPTION OF THE SEVERAL VIEWS OF THE DRAWING

A uniqueness of the present glove invention according to one embodiment is that it is interchangeable, able to be worn by either a right-handed or left-handed person possessing a similar hand size. The application and majority of the pictorial views of the present glove invention depicted by the use of a right-hand is for consistency and demonstration purposes only, and should not be construed as departing or detracting from the disclosed inventive principles, given that only two (2) pictorial views of the left-hand (FIG. 6 and FIG. 7) have been illustrated in the drawings herein. The advantages and features of the present invention and its embodiments will become better understood with reference to the following more detailed description and claims taken in conjunction with the accompanying illustrated drawings, in which like elements are identified with like symbols, and in which:

DETAILED DESCRIPTION OF THE INVENTION

Figure 1:
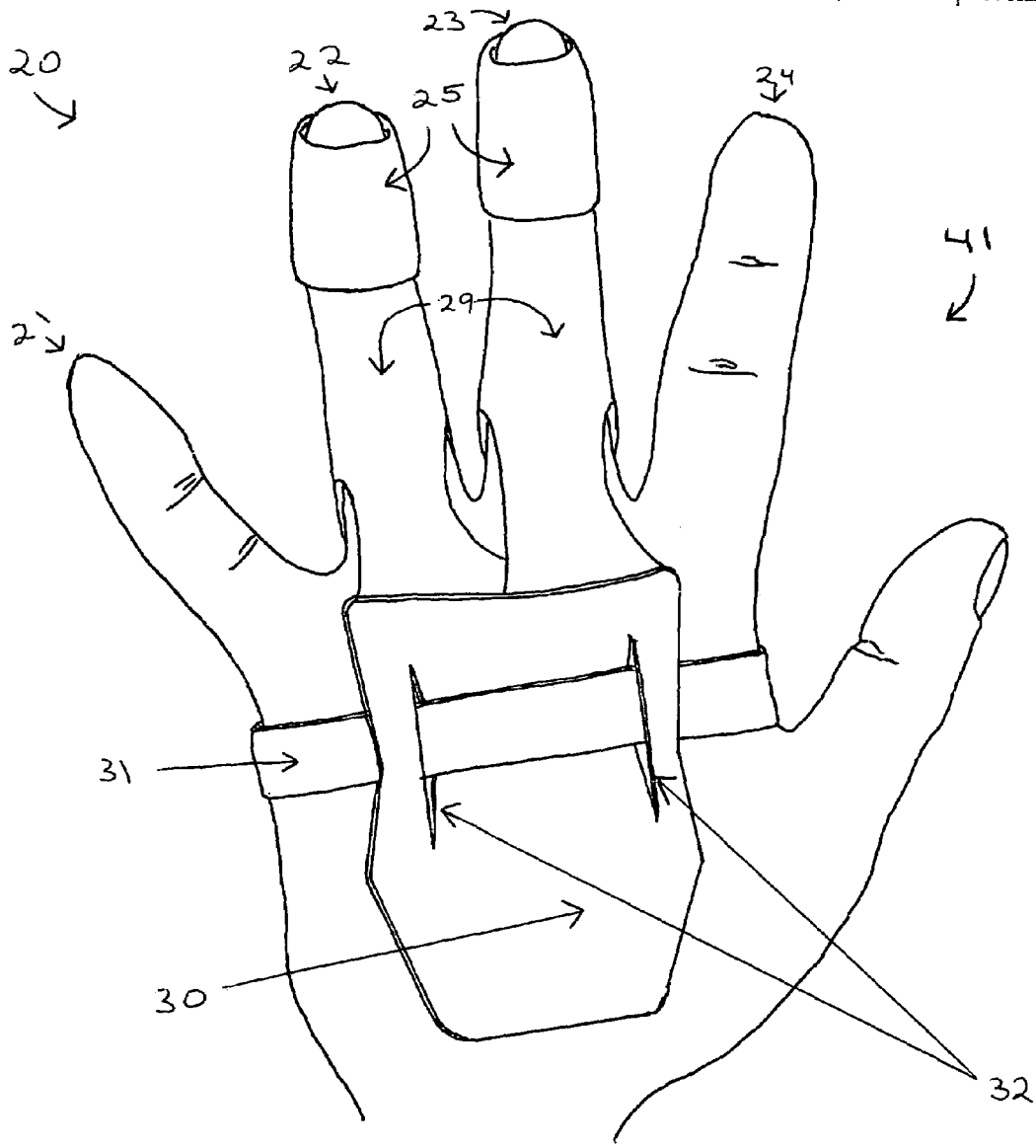
FIG. 1 shows a palm up view of the present glove invention, positioned over a bowler's right hand, consisting of the elastic, perspiration-retention, breathable fabric plus control/grip-enhanced material, according to one embodiment of the invention; the glove itself shown in partial view, covering a portion of the two middle fingers and a portion of the hand, secured to the hand via an adjustable, tension strap, shown partially.

In order to describe the present glove invention, it is essential that some description be given to the manner and practice of the functional utility of the control/grip-enhanced sports glove used during the activity of bowling. In one or more examples of the invention is presented in terms of one or more embodiments, herein depicted within the Figures.

As earlier stated, one feature of the present glove invention according to one embodiment, is that the glove is interchangeable, able to be worn and utilized by either a right-handed or left-handed bowler possessing a similar hand size. With the exception of two (2) views, the application of the present glove invention is illustrated in the Figures as being placed on the right hand. This is merely for consistency and demonstration purposes only, and does not depart or detract from the disclosed inventive principles, given that only two left-handed views have been depicted in the drawings shown herein.

In the drawings shown herein, the same numerals are used to show the same or similar parts.

FIG. 1 and subsequent descriptions and any embodiments of the present glove invention shown have been presented for purposes of illustration and description only. They are not intended to be exhaustive or to limit the invention to the precise forms disclosed, and obviously many modifications and variations are possible beyond what FIG. 1 and the other views depict.

Figure 7:
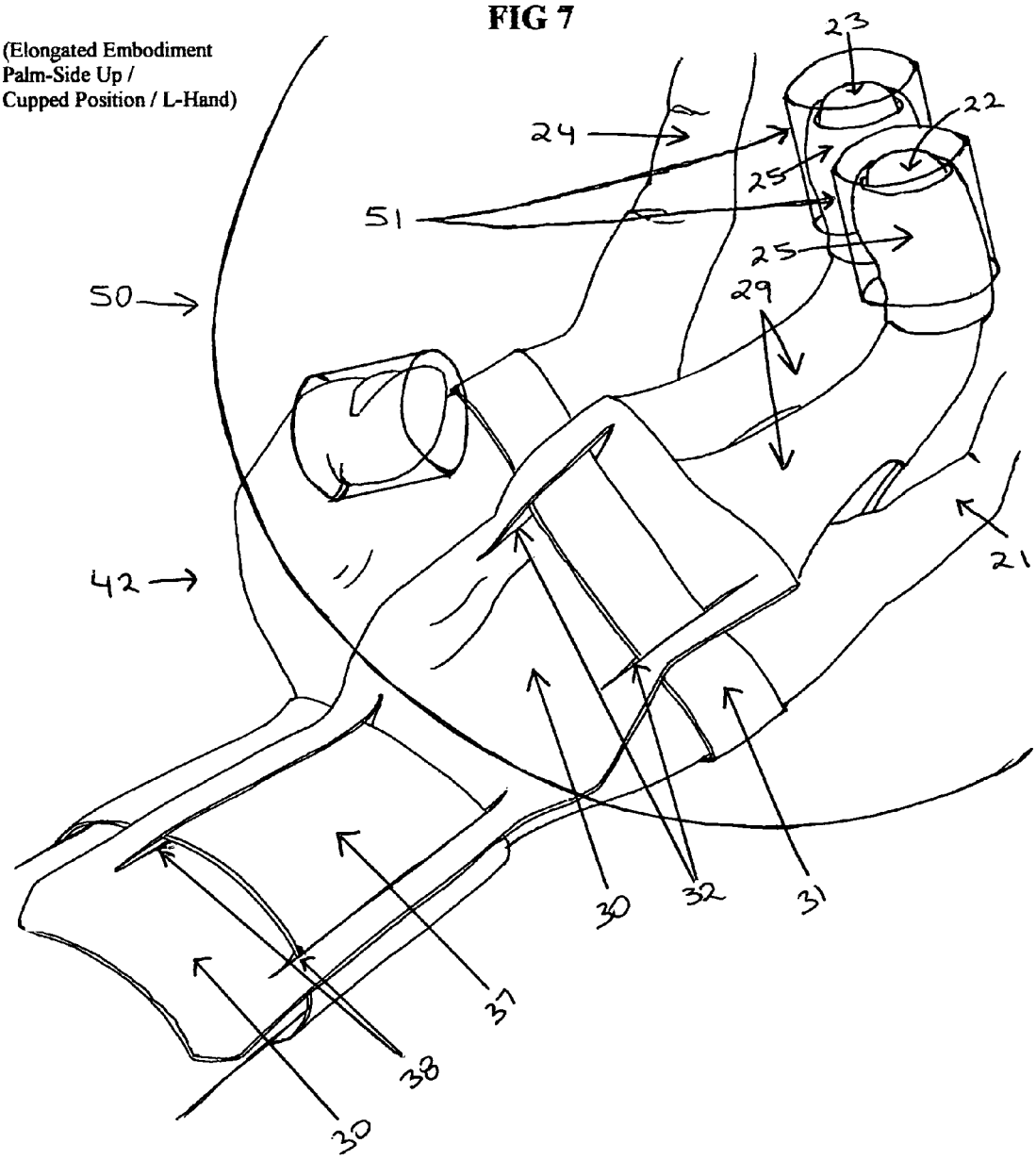
FIG. 7 shows an elongated palm-up view of an embodiment of the present glove invention of FIG. 1, the glove placed over the left hand and wrist of a bowler with the hand viewed in a "cupped" position, cradling a bowling ball in the palm of the left hand; the glove comprising an elastic, breathable, perspiration-retention fabric plus control/grip-enhanced material. The glove itself is seen covering a portion of the palm, wrist and two middle fingers of the left hand, with said fingers and thumb shown placed in the respective holes of a bowling ball. The elongated embodiment also shows the glove covering a portion of the hand and wrist areas; the glove secured to both the hand and wrist area via two (2) adjustable, tension straps; a narrow and adjustable tension strap shown intersecting the hand, as also shown in FIG. 1, with an additional, yet wider, adjustable tension strap shown covering a portion of the wrist, as also shown in FIG. 4.

FIG. 1 shows a palm-up view of the present glove invention 20 positioned over a portion of the right hand 41. The present glove invention according to one embodiment can be interchangeable, accommodating either the right or left hand. Though FIG. 1 shows the present glove invention placed over the right hand 41, the view of the glove worn over the left hand would be a mirror image of this view, as illustrated in FIG. 7, an elongated embodiment of the present glove invention of FIG. 1. The illustrations and views of the present glove invention and any embodiments described by the use of the right hand 41 as also depicted in FIGS. 3, 4, 5 and 9 are for demonstration and explanation purposes only and, in no way detracts from the basic principles of application or its interchangeable feature when the placement of the present glove invention or an example of an elongated embodiment shown placed over the left hand and middle two fingers 22 and 23 is applied, as demonstrated in FIG. 7.

FIG. 1 of the present glove invention shows the two middle fingers 22 and 23 covered, with the index finger 24 and pinky finger 21, both naked and exposed to the outside elements, in this example. However, possible embodiments to the present glove invention could encompass covering the forefinger 24 and/or pinky finger 21, as illustrated and depicted in phantom in FIGS. 4, 5 and 9. The index finger 24 is comparable in length to the ring finger 22. Therefore, should only the index finger 24 be included in an embodiment of the present glove invention, that is to say, in addition to the two covered middle fingers 22 and 23, should the index finger be covered with a 4-way stretch, elastic, breathable, perspiration-retention fabric 29, in addition to the same or similar control/grip-enhanced material covering a portion of the finger pad area of the index finger 24, the same or similar to the control/grip-enhanced material 25, which covers the two middle fingers 22 and 23, while the pinky finger 21 remains uncovered and naked, which is to say, exposed to the outside elements, the interchangeable feature of the present glove invention remains intact and unaffected. Again, this is due to the elastomeric properties of the 4-way, stretch, breathable, perspiration-retention fabric 29 that is seen covering the two middle fingers 22 and 23 of the hand. Only if an embodiment of the present glove invention includes the pinky finger 21 covered with a 4-way stretch, elastic, perspiration-retention and breathable fabric 29, as shown in phantom in FIGS. 4, 5 and 9 will the interchangeable feature of the present glove invention be incongruous, due to the obvious difference in length between the pinky finger compared against the lengths of the other three fingers of the hand 22, 23, and 24 of the average person, regardless of age or size.

Figure 2:
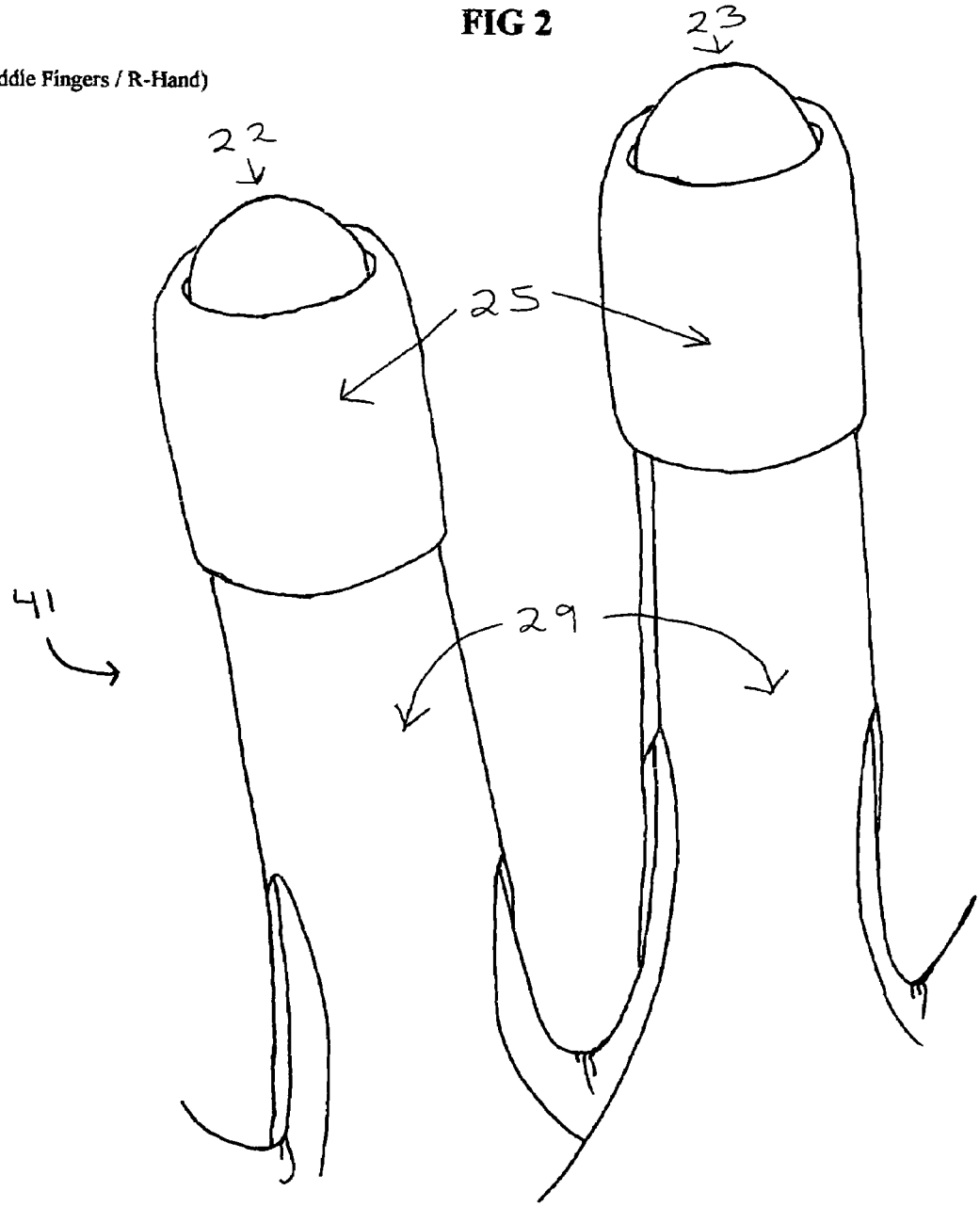
FIG. 2 shows a magnified, partial view of the present glove invention according to the embodiment of FIG. 1, illustrating the elastic, perspiration-retention, and breathable fabric covering a portion of the two middle fingers of the right hand; highlighting the affixed control/grip-enhanced material surrounding a portion of the fingertip areas of the two middle fingers.

The glove in FIGS. 1 and 2 shows an elastic fabric 29 covering a portion of both the ring finger 22 and middle finger 23. In FIG. 1, though only the two middle fingers are shown covered by the elastic fabric, as expressed, the present glove invention can be modified to embodiments where this or a similar elastic fabric 29 and the same or similar control/grip-enhanced material can accommodate and cover the pinky (little finger) 21 and/or the forefinger (index finger) 24 (illustrated in phantom in FIGS. 4, 5 and 9).

Figure 4:
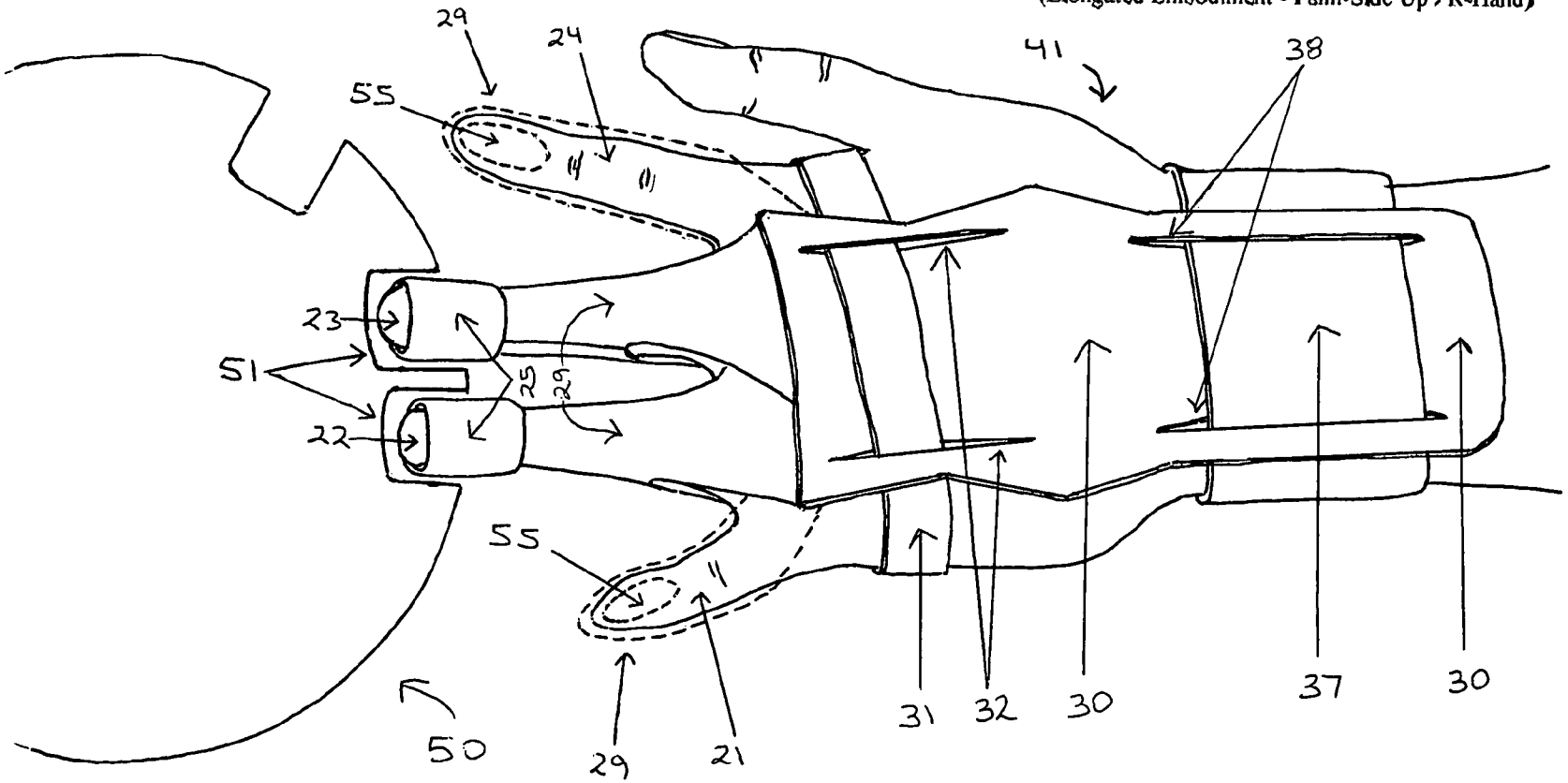
FIG. 4 shows an elongated, palm-up view of an embodiment of the present glove invention of FIG. 1, placed over the right hand of a bowler, comprising an elastic, breathable, perspiration-retention fabric plus control/grip-enhanced material. The glove itself is seen covering a portion of the palm and two middle fingers, with said fingers placed in the respective finger holes of a bowling ball; the option of encompassing the pinky and forefinger with the breathable fabric and a similar grip-enhanced material affixed atop the fabric along the finger pad area of said fingers, demonstrated in phantom. The elongated embodiment also shows the glove covering a portion of the hand and wrist areas; the glove secured to both the hand and wrist area via two (2) adjustable, tension straps, one strap intersecting the hand as shown in FIG. 1 with an additional, yet wider, adjustable tension strap covering a portion of the wrist, both shown partially.
Figure 5:
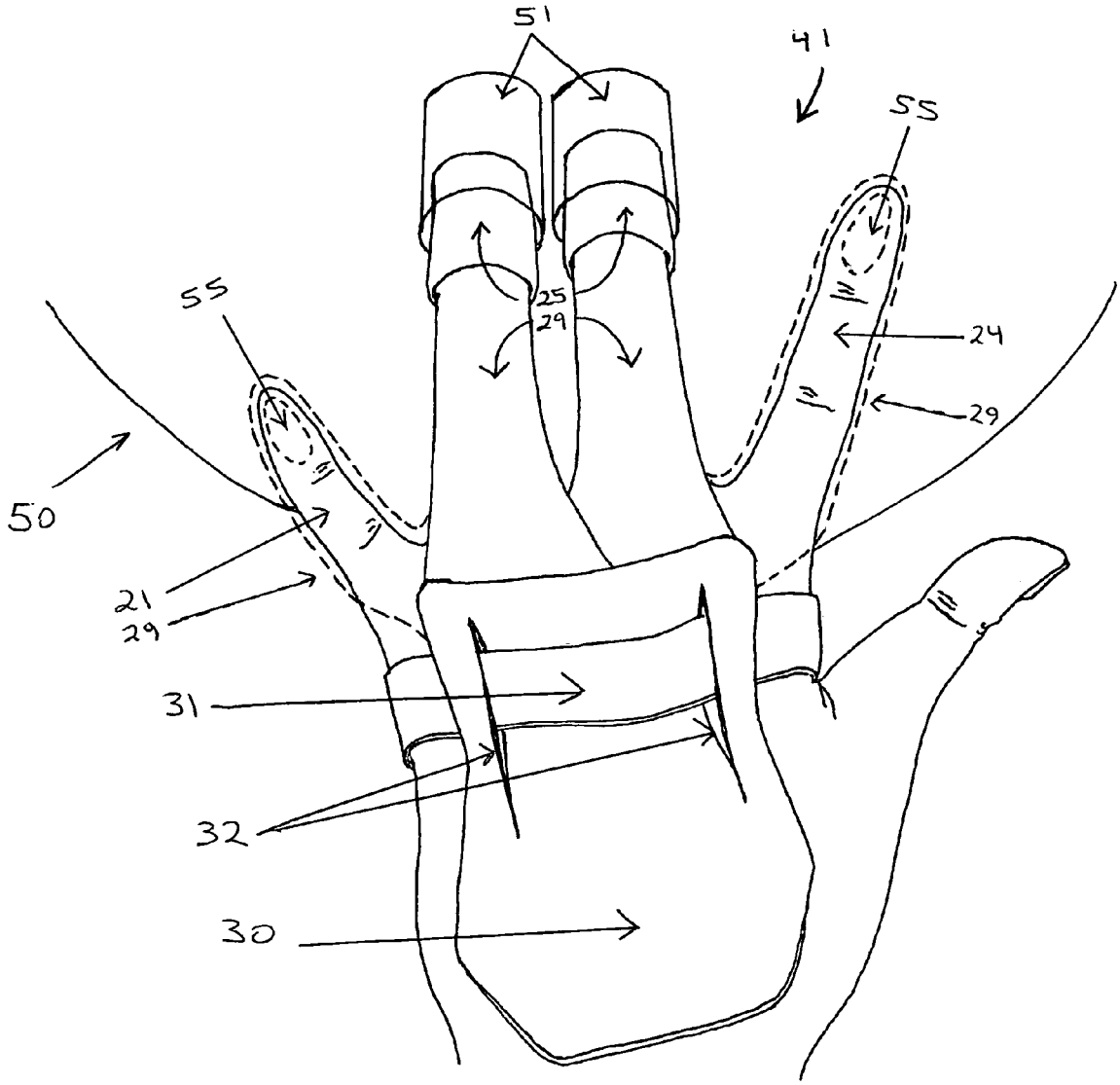
FIG. 5 shows a palm up view of the glove according to the embodiment of FIG. 1, placed over the right hand of a bowler, consisting of the elastic, breathable, perspiration-retention fabric plus control/grip-enhanced material; the glove itself seen covering a portion of the palm and two middle fingers, with said fingers placed in the respective finger holes of a bowling ball and, with the option of encompassing the pinky and forefinger with the elastic, breathable, perspiration-retention fabric and a similar grip-enhanced material affixed atop the fabric along the finger pad area of said fingers, as demonstrated in phantom and in FIG. 4. The glove is shown secured to the hand via an adjustable, tension strap, shown partially, as in FIG. 1.

The fabric in one example is an elastic, 4-way stretch, highly abrasive, breathable, yet perspiration-retention fabric that prevents any or substantial perspiration build-up along the fabric-covered portion of the ring finger 22, middle finger 23 and any other covered fingers, from secreting through the outer, exterior side of the elastic fabric and having contact with any part of an object, such as a bowling ball, to include the exterior surface of the ball, as well as the interior walls of the holes of a bowling ball, as illustrated in FIGS. 4, 5 and 7. Furthermore, although a person's middle finger is normally slightly longer and bigger in circumference than the ring finger, the 4-way stretch characteristic of the fabric coupled with the elastomericty of the control/grip-enhanced material surrounding the fingertip area 25 allows for the two middle fingers 22 and 23 of the glove invention 20 to be the same length, inviting a comfortable accommodation of whichever of the two middle fingers is inserted into a particular finger sleeve, whether of the left-hand or right-hand.

FIG. 1 also shows a control/grip-enhanced material 25 possessing in one example, elastomeric properties, shown affixed to the elastic fabric 29, which the elastic fabric 29 is also shown attached to both the control/grip-enhanced material 25 at the fingertip end of the glove and to the control/grip-enhanced material 30 of the palm area of the glove. In a complete, sphere-shaped manner, the control/grip-enhanced material 25 in one example, surrounds a portion of the fingertips of the ring finger 22 and the middle finger 23, exposing the very tip (i.e. top) of the two middle fingers to the outside elements to enhance breathability through the top of the glove, by allowing for the evaporation of any perspiration build-up around the fingertip or finger pad area of the covered two middle fingers. This is further exhibited in FIGS. 2, 3, 4, 6, 7, and 9.

Figure 6:
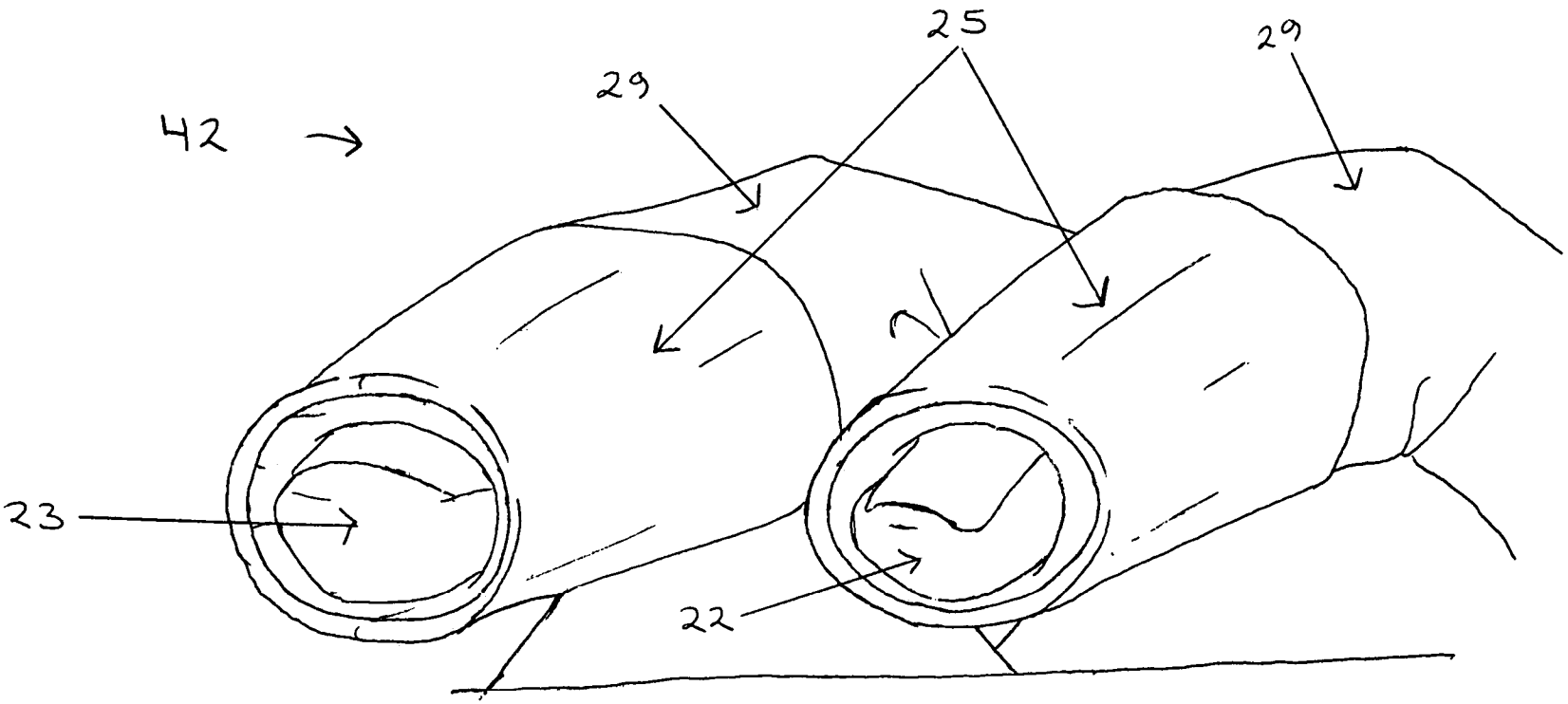
FIG. 6 shows a magnified, partial view of the present glove invention according to the embodiment of FIG. 1, illustrating and highlighting the elastic, perspiration-retention, and breathable fabric covering a portion of the two middle fingers of the left hand; emphasizing the affixed control/grip-enhanced material surrounding a portion of the fingertip areas of the two middle fingers of the left hand.
Figure 10:
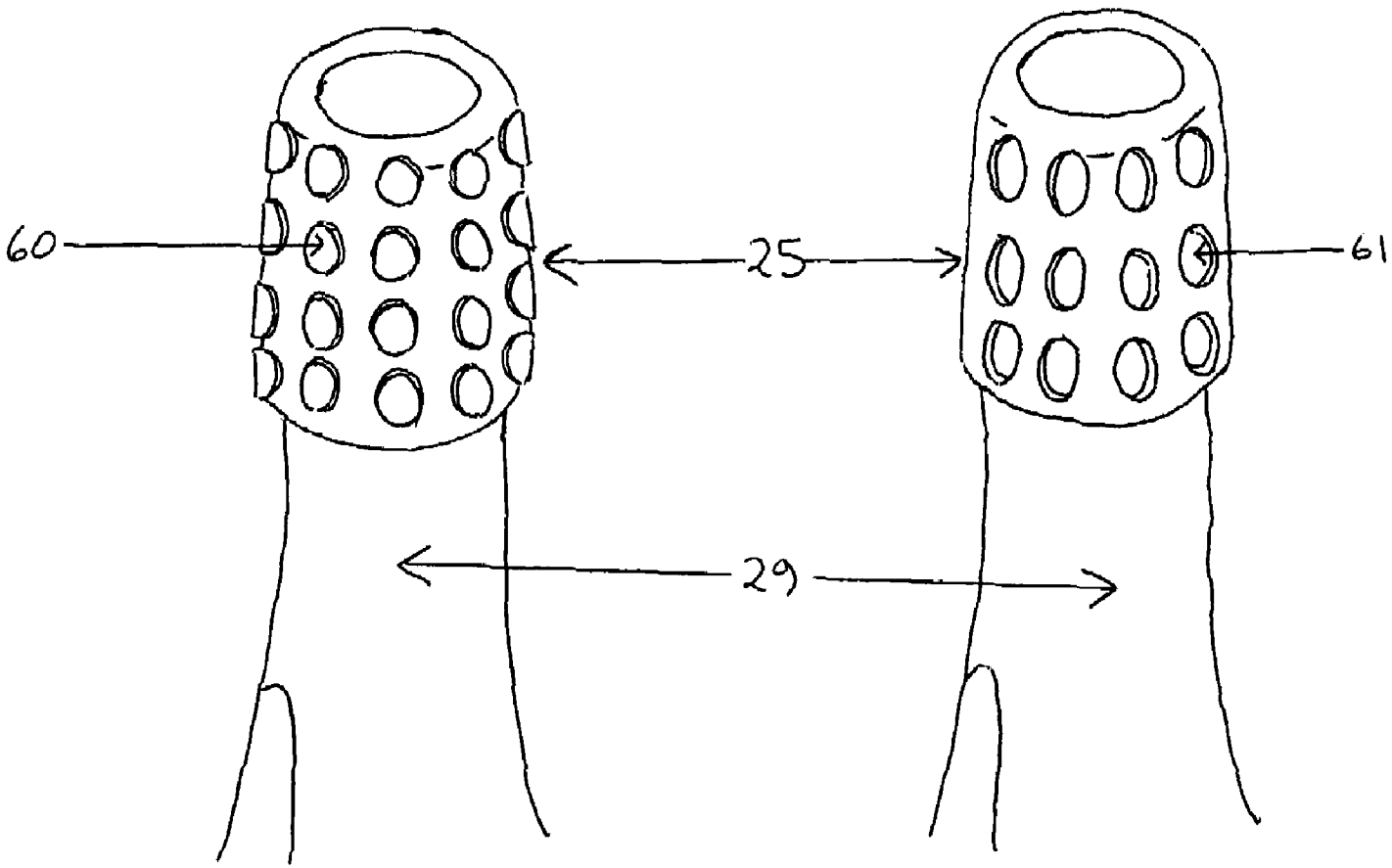
FIG. 10 shows a magnified, partial view of an embodiment of the present glove invention of FIG. 1, illustrating and emphasizing two of several examples of textured, control/grip-enhanced materials, which surrounds the fingertip areas of at least the two middle fingers. Shown are examples of a "dot-patterned" control-grip enhanced material and a control-gripped "mesh" textured material. Also shown in partial view is a portion of the elastic, perspiration-retention, and breathable fabric, attached to the control/grip-enhanced material and, which covers a portion of the shaft of the finger(s) of which is/are placed inside the fabric sheath.

The control/grip-enhanced material surrounding the fingertips can be of different surface textures and elastomeric properties, both on the unseen, underside and the visible exterior side of the control/grip-enhanced material, as further exhibited in FIG. 10; this to match up to the desired surface and textural preferences of the bowler, as well as to a bowler's performance requirements (i.e. ball revolutions) directly related to the bowler's abilities and lane oil conditions. The interior surface texture of the control/grip-enhanced material 25 which surrounds the tips of the two middle fingers 22 and 23 of the present glove invention, which is to say, the unseen, underside of the control/grip-enhanced material 25, that side that has direct contact with the fingertip/finger pad area of the ring and middle fingers 22 and 23, coupled with surface texture of the exterior side of the control/grip-enhanced material, which is to say, the visible side which has direct contact against the interior walls of a bowling ball may be similar to the grippy, spongy, rubbery feeling attained from common cylindrical inserts/grips, normally secured in place inside each of the bored finger holes of a bowling ball, which most bowlers are accustomed to using. The range of embodiments of the present glove invention, particularly with respect to the control/grip-enhanced material 25 which circumferences the two middle fingers 22 and 23, also allows for a variety of textural surfaces to both: 1) the exterior side of control/grip-enhanced material; that surface side which comes into direct contact with the walls of the bowling ball holes, as illustrated in FIG. 10 and, 2) on the hidden, unseen side of the control/grip-enhanced material; that side which comes into direct contact with the covered fingers, normally, the two covered middle fingers 22 and 23 as depicted in FIG. 6.

With respect to the textural effect capabilities on the hidden, unseen side of the control/grip-enhanced material, that is to say, the side which has direct contact with the fingertip or finger pad of the two covered middle fingers, 22 and 23, embodiments of the present glove invention can also incorporate a variety of textured "feels" of the elastomeric, control/grip-enhanced material on the underside of the material that has direct contact with the fingertip/finger pads; features often found among cylindrical inserts/grips. This original characteristic of the present glove invention from very textured surfaces to completely smooth surfaces of the control-grip-enhanced material 25, both interiorly and/or exteriorly, independently or in combination, would provide the bowler a selection of surface textures at the fingertip area, again, both exteriorly and interiorly, based on personal preferences and the dictates of lane conditions as they directly match up to the bowler's abilities and equipment selection (i.e. bowling ball choice). However, unlike cylindrical inserts/grips, the present glove invention 20 significantly reduces the chance of injuries and abuse to areas on or around the two middle finger tips by the repetitive and violent release of the bowling ball off these fingers onto the lane, the covered finger pads areas of the two middle fingers 22 and 23. Additionally, as illustrated in FIGS. 1, 2, 3, 4, 5, 6, 7, and 9, the present glove invention 20 prevents perspiration secreted from the finger pad/fingertip areas of these two fingers and/or any other covered fingers inserted into bowling ball holes designed for the placement of fingers, from having a detrimental impact and negative effect on ball motion, bowler performance and, scoring potential due to 1) squeezing of the bowling ball and/or, 2) ball slippage off the hand during the pendulum swing and release of the ball onto the lane.

In one embodiment, the combination of the exterior and interior surface of the control/grip-enhanced, elastomeric material 25 surrounding the two middle fingertips 22 and 23 drastically increases ball control, affording the bowler the ability to roll the ball onto the desired part of the lane on a consistent basis, unequal in comparison to any naked, uncovered fingers extracting from the finger holes of the ball at point of release; this, due to perspiration around the inserted two middle finger tips 22 and 23, resulting in less than optimum frictional contact between the two middle finger tips and the bored finger holes of a ball, with or without the use of inserts/grips. Again, as would be evident to anyone skilled in the art of bowling, modifications and embodiments of the present glove invention may include the pinky (little finger) 21 and/or the forefinger (index finger) 24 covered with the same or similar elastic fabric 29, a portion of which would be covered with a control/grip-enhanced material 25, the same or similar to that which covers the two middle fingers 22 and 23 and, as further demonstrated in FIGS. 4 and 5 (illustrated in phantom). The combination of the elastic fabric 29 and the control/grip-enhanced material 25 of the present glove invention and its embodiments, completely blocks perspiration secreted from around any part of any covered fingers, especially the finger pad/fingertip areas of the two middle fingers 22 and 23 from coming into contact with any part of a bowling ball, exteriorly and more importantly, interiorly, as illustrated in FIGS. 4, 5, and 7. The frictional, grip properties of the control/grip-enhanced material 25 enhances the bowler's ability and considerably increases the bowler's consistency in ball control and effective ball lift and release off the two middle fingers onto the lanes.

FIG. 1 shows on the palm area of one embodiment of the present invention, a control/grip-enhanced material 30, which could be the same or similar to the control/grip enhanced material used around the fingertips 25 and an adjustable, tension strap 31, of the same or similar non-skid, control/grip-enhanced, elastomeric material; the combined purpose which is to grip the exterior surface of any part of the bowling ball which comes into contact with the palm material 30 and tension strap material 31 by friction force as demonstrated in FIGS. 4, 5 and 7. The control/grip-enhanced materialed surface and relationship between the palm material 30 and the exterior ball surface is maintained, regardless of the bowler's hand movement slightly forward, back (as in a cupped-hand position), or tilted laterally from side to side; movements that impact and affect ball motion (i.e. axis rotation, tilt and ball revolution).

The control/grip material of the palm area 30 of the present glove invention 20 allows the bowler, especially at the intermediate or advanced level, the ability to "tweak" and position the placement of the bowling ball in the palm and cup of the hand, as illustrated in FIG. 7, positioning the hand and ball together at the desired angle or tilt while in the approach position, ultimately imparting the desired ball roll (i.e. axis rotation, tilt and ball revolution) at point of release of the ball off the hand and onto the lane.

Figure 3:
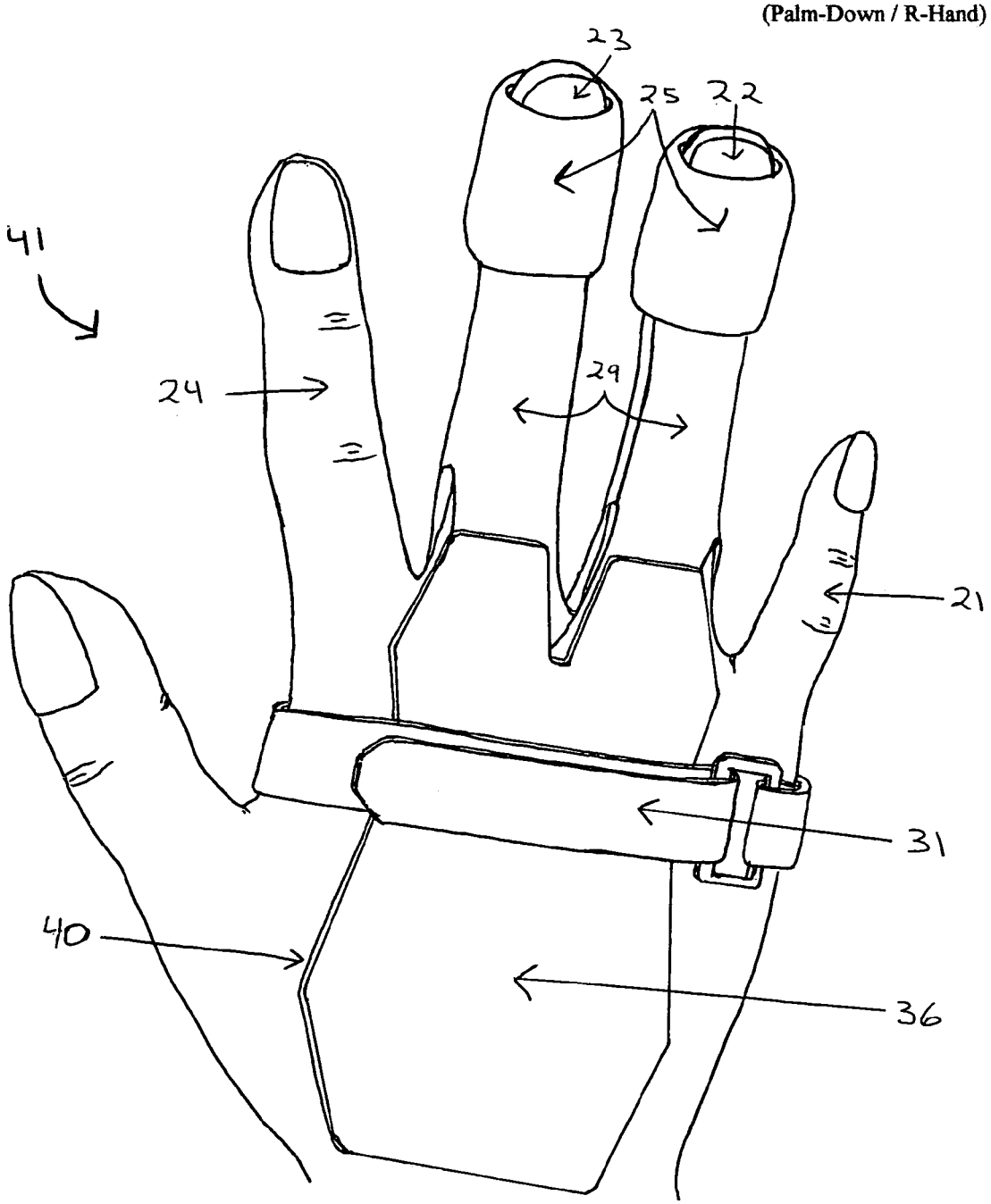
FIG. 3 shows a back-of-the-hand, palm-down view of the present glove invention according to the embodiment of FIG. 1, positioned over a bowler's right hand, consisting of the elastic, perspiration-retention, breathable fabric plus control/grip-enhanced material; the glove itself seen covering a portion of the two middle fingers and hand, secured to the hand via an adjustable, tension strap, shown partially.
Figure 8:
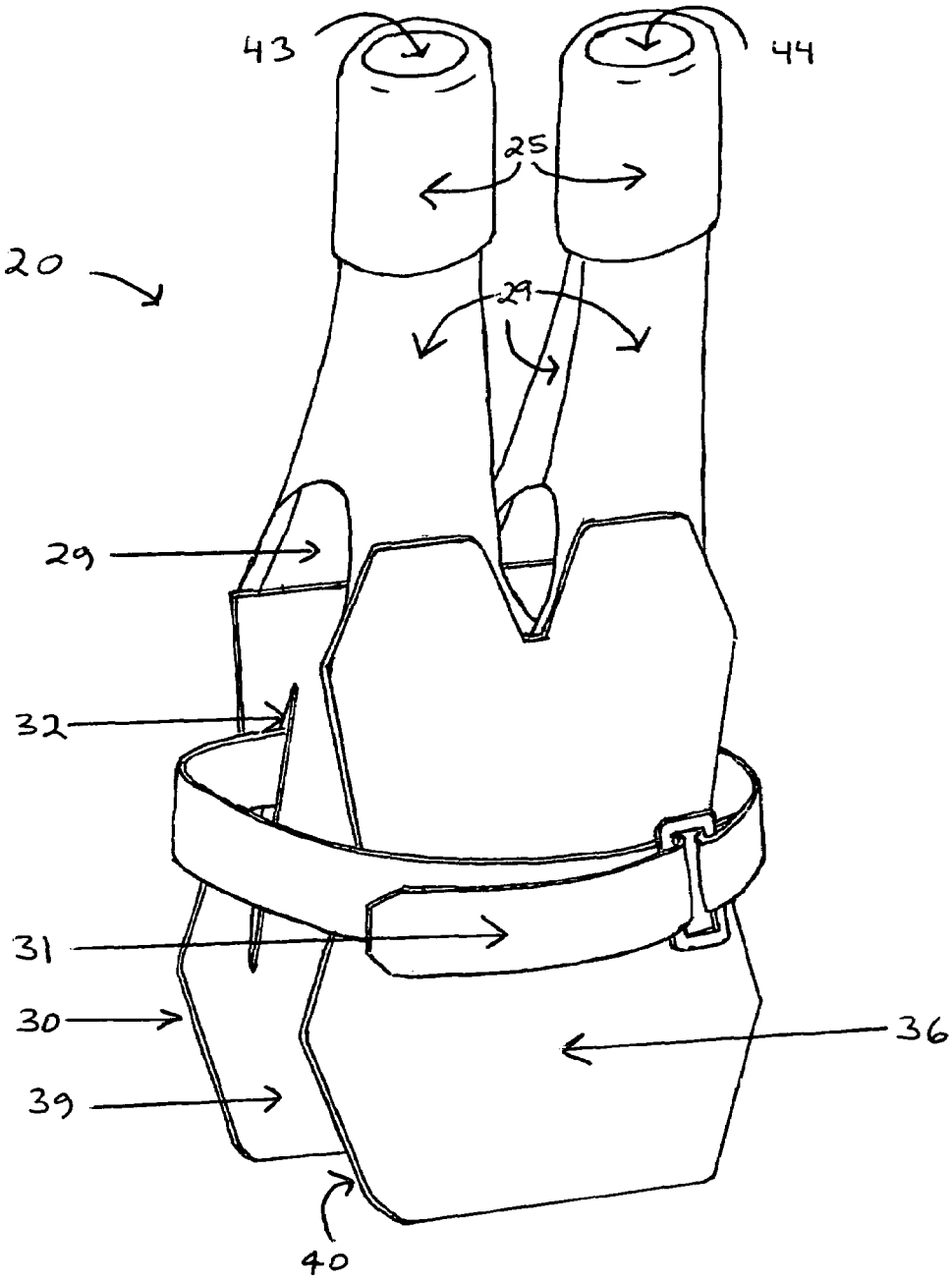
FIG. 8 shows a back-of-glove view of the present glove invention according to the embodiment of FIG. 1, illustrating the clam-like manner, in which either the right or left hand and two middle fingers are inserted in the glove in a sandwich-like manner; the glove comprising an elastic, breathable, perspiration-retention fabric plus control/grip-enhanced material. Also highlighted is a portion of the adjustable tension strap, which wraps around the approximate middle of the hand, securing the glove to the hand.
Figure 9:
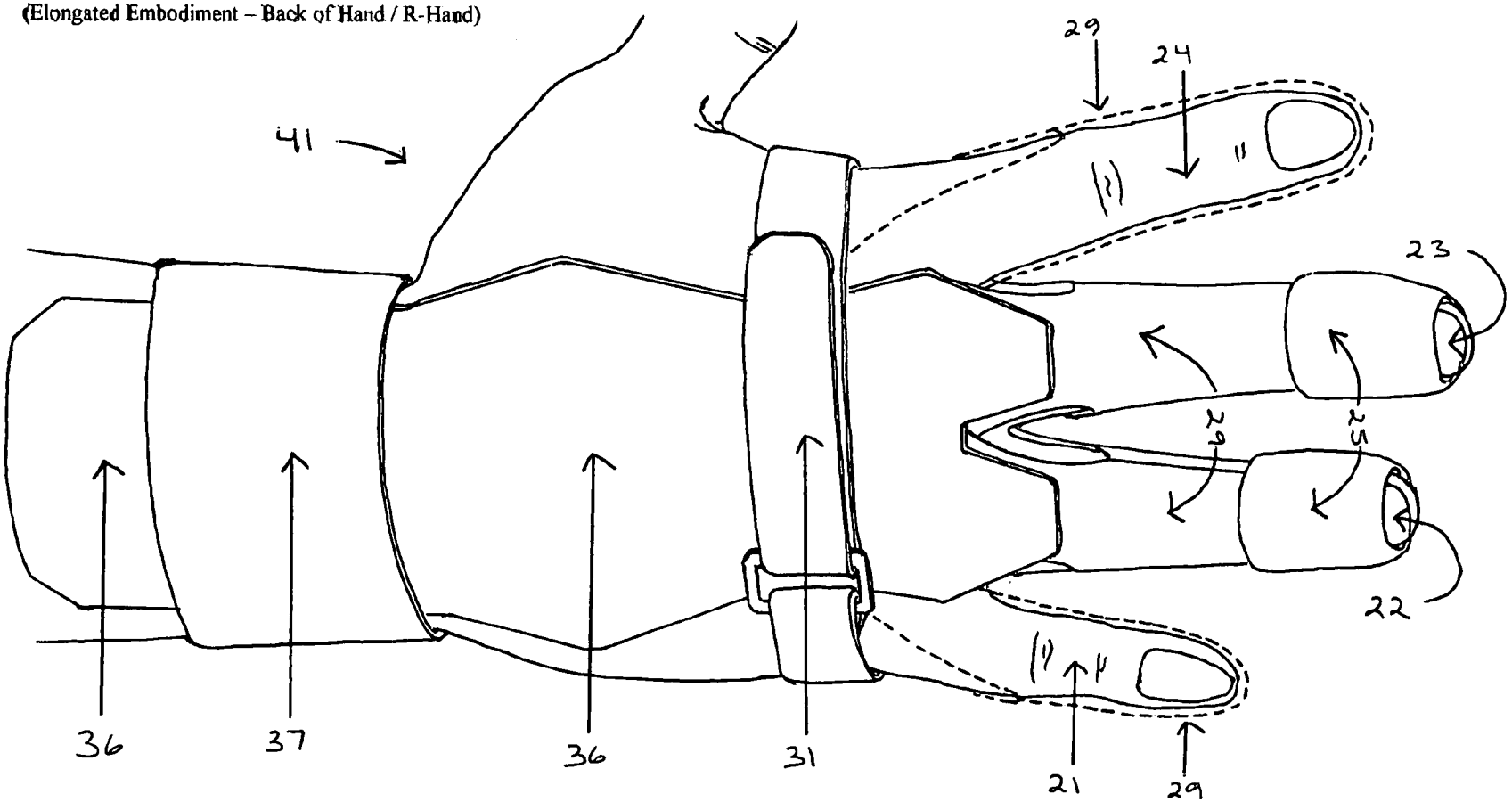
FIG. 9 shows an elongated, back-of-the-hand view of an embodiment of the present glove invention of FIG. 1, positioned over the right hand of a bowler, comprising an elastic, perspiration-retention, breathable fabric plus control/grip-enhanced material; the glove itself shown covering a portion of the back of the hand, wrist and the two middle fingers, along with the option of encompassing the pinky and forefinger with the breathable fabric and a similar grip-enhanced material along and/or around said fingers, as demonstrated in phantom. Also shown is a view of a narrow, adjustable, tension strap wrapped around the middle of the hand plus, a wider adjustable, tension strap wrapped around the wrist; both straps shown in partial view.

FIG. 1 of the present glove invention shows one example of a control/grip-enhanced, adjustable tension strap 31 intersecting and wrapping around the approximate center of the palm of the bowler's hand, securing itself to the back of the hand in a hook and loop fastener system, as illustrated in FIGS. 3, 8 and 9. A good example of such a hook and loop fastener is sold under the trademark VELCRO® and can be used to attach to the base material 31. As would be apparent to anyone skilled in the art of bowling, the VELCRO® hook and loop type, fastening material surfaces could be reversed and other means known by those skilled in the art could be used to secure the adjustable tension strap 31 in its adjusted position, without departing from the principles of the disclosed invention. The slits 32 on the palm area 30 in the present example accommodates the adjustable tension strap 31, attaching to the palm area of the glove 30 via the slits 32, allowing the bowler to position or adjust the tension strap 31 to the hand in an up-and-down sliding manner through the slits to the desired "feel" and location around the hand. Likewise, as the present glove invention is interchangeable in this example embodiment, the same glove offers a right-handed or left-handed person possessing similar hand size the option, should the bowler desire, of removing the adjustable tension strap 31 from the glove slits 32, reversing the strap's direction by interlacing and securing the strap to the glove through the slits 32 in the opposite direction. Moreover, the slits 32 allow the bowler to maintain the optimum feel and position of the glove itself to the hand without disturbing the location and position of the adjustable tension strap 31 by slightly tugging at the end of the control/grip-enhanced material of the palm 30 toward the bowler, in a downward manner. Additionally, the glove can be further adjusted around the fingertips of the two middle fingers 22 and 23, if need be, by slightly tugging on the elastic material 29 of either one or both of the two covered middle fingers 22 and/or 23 toward the bowler, to gain the desired effect and position of the cylindrically-shaped control/grip enhanced material 29 over the two middle fingers 22 and/or 23, to expose (i.e. protrude) or to cover (i.e. hide) more or less of the actual tip of the fingers to or from the natural elements.

Any required adjustment of the glove position on the hand and, more specifically, around the tips of the two middle fingers will usually occur after the release of the bowling ball off the covered, inserted middle fingers 22 and 23, as shown in FIGS. 4 and 5, and 7.

FIG. 2 shows a close-up view of an example of the present glove invention of FIG. 1, highlighting and isolating the elastic, 4-way stretch, highly abrasive breathable, perspiration-retention fabric 29 covering the ring finger 22 and middle finger 23 of the right hand 41; accentuating the control/grip-enhanced material 25 affixed to the elastic, breathable fabric 29. In a complete, sphere-shaped manner, the control/grip-enhanced material is shown surrounding a portion of the fingertips of the ring finger 22 and the middle finger 23, exposing the very tip of the two middle fingers to the outside elements. This is further exhibited in FIGS. 1, 3, 4, 6, 7, and 9. The range of embodiments of the present glove invention, specifically the control/grip-enhanced material circumferencing the two middle fingers 22 and 23, permits a variety of textural surface options to both the interior, unseen side, as well as the visible, exterior side of the control/grip-enhanced material 25, as previously explained in FIG. 1 and further illustrated in FIG. 10.

FIG. 3 illustrates a back-of-the-hand, palm-down view of another example of the present glove invention of FIG. 1 positioned over a portion of the right hand 41. FIG. 3 shows how the elastic, 4-way stretch, abrasive-resistant, perspiration-retention and breathable fabric 29 covers both the ring finger 22 and middle finger 23, as further illustrated in FIGS. 1, 2, 4, 5 and 9. Shown connected at the end of the elastic fabric 29 at the fingertip area of the glove is a control/grip-enhanced, elastomeric material 25 affixed to the elastic fabric 29. And, as can be seen in FIGS. 1 3 and 6, in a complete, sphere-shaped manner, the control/grip-enhanced material surrounds or circumferences, in one example, a portion of the fingertips of the ring finger 22 and the middle finger 23, exposing the very tips of the two middle fingers to the outside elements to permit additional breathability at the fingertip area; the purpose, function and potential options previously addressed in FIG. 1 with several potential embodiments illustrated in FIGS. 4, 5, 9, and 10. FIG. 3 shows the elastic fabric 29 attached to a coated or laminated material 36, connecting to each other at the approximate middle of the base knuckle of the hand and also, the approximate middle knuckles of the two middle fingers 22 and 23. The coated or laminated material 36, in one example, can be seen sandwiched to the control/grip-enhanced material 40 of the same shape and size and length, with side 40 having direct contact with the back of the bowler's hand. This is further depicted in FIG. 8.

FIG. 3 also shows the adjustable, tension strap 31 of the same or similar non-skid, control/grip-enhanced material as 25; the control/grip-enhanced, adjustable tension strap of the present glove invention is seen overlaid atop the coated or laminated material of the glove 36 across the approximate center of the back of the hand, securing itself to the back of the hand in a hook and loop fastener system, as also illustrated in FIGS. 8 and 9. A good example of such a hook and loop fastener is sold under the trademark VELCRO® and can be used to attach to the base material 31. As would be apparent to anyone skilled in the art of bowling, the VELCRO® hook and loop type, fastening material surfaces could be reversed and other means known by those skilled in the art could be used to secure the adjustable tension strap 31 in its adjusted position, without departing from the principles of the disclosed invention. As the present glove invention in this embodiment is interchangeable, providing the pinky finger 21 remains uncovered and naked to the outside elements, the same glove offers a right-handed or left-handed person possessing a similar hand size the option of removing the adjustable tension strap 31, which is seen strapped around the knife-edge of the hand on the pinky-side 21, reversing the strap's direction, and having the hook-and-loop fastening system on the other side of the hand near the crease between the thumb and forefinger 24 or, secured anywhere around the glove to the bowler's liking. Moreover, the bowler is able to maintain the optimum feel and position of the back of the glove to the hand without disturbing the location and position of the adjustable tension strap 31 by slightly tugging at the end of the back of the glove 36 and 40 toward the bowler and, in a downward manner. Additionally, the glove can be further adjusted around the fingertips of the two middle fingers 22 and 23, if need be, by slightly tugging on the elastic material 29 of either one or both of the two covered middle fingers 22 and/or 23 to gain the desired effect and position of the cylindrically-shaped control/grip enhanced material 29 over the two middle fingers 22 and/or 23, to expose (i.e. protrude) or cover (i.e. hide) more or less of the actual tip of the fingers to or from the natural elements. Any required adjustment of the glove position on the hand and, more specifically, around the tips of the two middle fingers will usually occur after the release of the bowling ball off the covered, inserted middle fingers 22 and 23, as shown in FIGS. 4 and 5, and 7.

FIG. 4 shows an elongated, palm-up view of an embodiment of the present glove invention of FIG. 1, with the right hand of the bowler 41 inserted into the glove. The glove's control/grip-enhanced material 30 of this elongated embodiment can be seen covering a portion of the palm of the hand and extending down over the right wrist area.

FIG. 3 also shows the adjustable, tension strap 31 of the same or similar non-skid, control/grip-enhanced material as 25; the control/grip-enhanced, adjustable tension strap of the present glove invention is seen overlaid atop the coated or laminated material of the glove 36 across the approximate center of the back of the hand, securing itself to the back of the hand in a hook and loop fastener system, as also illustrated in FIGS. 8 and 9. A good example of such a hook and loop fastener is sold under the trademark VELCRO® and can be used to attach to the base material 31. As would be apparent to anyone skilled in the art of bowling, the VELCRO® hook and loop type, fastening material surfaces could be reversed and other means known by those skilled in the art could be used to secure the adjustable tension strap 31 in its adjusted position, without departing from the principles of the disclosed invention. As the present glove invention in this embodiment is interchangeable, providing the pinky finger 21 remains uncovered and naked to the outside elements, the same glove offers a right-handed or left-handed person possessing a similar hand size the option of removing the adjustable tension strap 31, which is seen strapped around the knife-edge of the hand on the pinky-side 21, reversing the strap's direction, and having the hook-and-loop fastening system on the other side of the hand near the crease between the thumb and forefinger 24 or, secured anywhere around the glove to the bowler's liking. Moreover, the bowler is able to maintain the optimum feel and position of the back of the glove to the hand without disturbing the location and position of the adjustable tension strap 31 by slightly tugging at the end of the back of the glove 36 and 40 toward the bowler and, in a downward manner. Additionally, the glove can be further adjusted around the fingertips of the two middle fingers 22 and 23, if need be, by slightly tugging on the elastic material 29 of either one or both of the two covered middle fingers 22 and/or 23 to gain the desired effect and position of the cylindrically-shaped control/grip enhanced material 29 over the two middle fingers 22 and/or 23, to expose (i.e. protrude) or cover (i.e. hide) more or less of the actual tip of the fingers to or from the natural elements. Any required adjustment of the glove position on the hand and, more specifically, around the tips of the two middle fingers will usually occur after the release of the bowling ball off the covered, inserted middle fingers 22 and 23, as shown in FIGS. 4 and 5, and 7.

FIG. 4 shows an elongated, palm-up view of an embodiment of the present glove invention of FIG. 1, with the right hand of the bowler 41 inserted into the glove. The glove's control/grip-enhanced material 30 of this elongated embodiment can be seen covering a portion of the palm of the hand and extending down over the right wrist area.

The very tip (i.e. top) of the ring and middle fingers 22 and 23 are shown exposed, as earlier viewed in FIG. 2 and as further illustrated in FIGS. 1, 3, 6, 7 and 9. The bowler's ring finger 22 and middle finger 23 around the finger pad area are surrounded with a control/grip-enhanced, elastomeric material with said fingers engaged in their respective finger holes 51 of a bowling ball 50, emphasizing the grip-enhanced material 25 making maximum, frictional and flush contact against the interior walls of the finger holes 51. The two middle fingers 22 and 23 are also seen covered with the 4-way stretch, elastic, perspiration-retention, and breathable fabric 29, which is seen connected to the control/grip-enhanced material at points 25 and 30. As may be appreciated by one skilled in the art of bowling, a further modification and embodiment of the present glove invention may include the pinky (little finger) 21 and/or the forefinger (index finger) 24 to be covered with the elastic fabric 29 and a similar control/grip-enhanced material 55, the same or similar as used along the fingertips area of the two middle fingers 21 and 24, as shown in FIGS. 4 and 5 (illustrated in phantom), enhancing control and further increasing rev potential through finger pressure of fingers 21 and 24 applied to the exterior surface of the bowling ball 50. As previously discussed in FIGS. 1 and 2, embodiments to the control/grip-enhanced material 25 around the two middle fingers 22 and 23, would include a range of textural surface options to both the unseen, interior side of the control/grip-enhanced material and the exterior side of the control/grip-enhanced material surrounding the two middle fingers. Examples of exterior surface options to the fingertip area of the present glove invention are further revealed in FIG. 10.

FIG. 4 also shows the elongated embodiment of the present glove invention secured to the hand and wrist area via two (2) adjustable, tension straps made from a control/grip-enhanced material similar or the same as the material used over the palm of the hand 30. A portion of the narrower of the two adjustable tension straps 31 can be seen overlaying the control/grip-enhanced material of the palm of the glove 30, intersecting the approximate center of the hand, crossing the knife-edge of the hand and bisecting the crease of the hand between the forefinger 24 and thumb. In this example, the narrower, adjustable tension strap 31 is shown secured to the glove via incisioned slits 32 of the control/grip-enhanced material on the palm side of the glove 30, with this strap interlaced through the slits, as further revealed in FIGS. 1, 5 and 7. The slits allow the bowler to adjust the tension strap 31 to the desired position and location on and/or around the hand area of the glove.

Furthermore, the bowler is able to tweak and adjust the glove to the hand as need be, by tugging on 30 toward the bowler, without disturbing the position of this adjustable tension strap. FIG. 4 also illustrates a wider adjustable tension strap 37 made from the same or similar control/grip-enhanced material of 30 and 31 as shown covering and providing tension support to the wrist area; the function and purpose of which is to restrict rotational movement of the wrist, providing the bowler a measure of support in the wrist area, as some bowlers desire or require support of the wrist due to age, bone disease, arthritis or weakness of the wrist in general, especially when holding, controlling and/or rolling a heavy object, such as a bowling ball 50. This elongated embodiment of the present glove invention of FIG. 1 is further illustrated in FIGS. 5, 7 and 9. The adjustable tension strap 37 provides the bowler taut, wrist support throughout the entire approach and delivery process. As with the narrower adjustable, tension strap 31, the wider, adjustable tension strap 37 is secured to the glove around the wrist via incisioned slits 38 in the control/grip-enhanced material 30 near the wrist end of the glove where the tension strap is interlaced. Likewise, these slits 38 allow the bowler to adjust the tension strap 37 to the desired position and location on and/or around the wrist area of the glove. The bowler also has the option to reverse the direction of this adjustable tension strap 37, securing it to the wrist from the opposite direction. The bowler is able to further tweak and adjust the glove to the hand around the wrist area as need be, by tugging on the "lip" of the control/grip-enhanced material 30 near the wrist area without disturbing the position and tautness of this wider adjustable tension strap 37 secured taut around the wrist. Each of the adjustable tension straps 31 and 37 secures to itself in a hook and loop fastener system. A good example of such a hook and loop fastener is sold under the trademark VELCRO® and can be used to attach to the control/grip-enhanced base material of 31 and of 37. However, as would be apparent to one skilled in the art of bowling, the VELCRO® hook and loop type, fastening material surfaces could be reversed and other means known by those skilled in the art could be used to secure the adjustable tension straps of 31 and 37 in its adjusted position, without departing from the principles of the disclosed invention.

FIG. 5 shows a palm-up view of the present glove invention of FIG. 1, placed over and covering a portion of the palm of the right hand 41 and two middle fingers. The two middle fingers are shown inserted into their respective finger holes 51 of a bowling ball 50, emphasizing the grip-enhanced, elastomeric material 25 circumferencing the fingertip/finger pad areas of the two middle fingers, demonstrating maximum, frictional and flush contact against the interior walls of the two finger holes 51 as further illustrated in FIGS. 4 and 7.

As previously explained in FIGS. 1 and 2, the grip-enhanced, elastomeric material 25 at the fingertip end of the glove completely eliminates or substantially reduces perspiration from secreting outside the material, thus having no contact with the interior walls of the finger holes 51 of the bowling ball. This results in significantly reduced ball slippage off of the two middle fingers that normally occurs during the holding and gripping of a ball 50. This grip-enhanced, elastomeric material simultaneously provides the bowler a substantially more consistent and effective ball release off of the control/grip-enhanced, material-covered fingertips 25. Furthermore, the bowler can impart a higher degree of stored energy to and through the bowling ball 50 due to the friction generated between the grip-enhanced, material 25 surrounding the fingertips and the interior walls of the finger holes 51 of the bowling ball. One knowledgeable in the art of bowling immediately recognizes that a strong, frictional ball release off of the two middle fingers, specifically, the ring finger and the middle finger, as illustrated and discussed in FIGS. 4 and 7 translates into the potential of imparting a high degree of stored ball energy, resulting in an increase in ball "rev" potential and effective ball motion. This ideally, will result in a more effective pin scattering at point of impact between ball and pins, ultimately increasing scoring potential.

FIG. 5 reveals the 4-way stretch, elastic, perspiration-retention, breathable fabric 29 covering the two middle fingers, the purpose and function having previously been illustrated and explained in FIGS. 1, 2, and 4, according to an example embodiment of invention. Again, it would be apparent to those skilled in the art of bowling that options or embodiments of the present glove invention of FIG. 1, would encompass the forefinger 24 and/or pinky finger 21 with the elastic fabric 29 plus the same or similar control/grip-enhanced material 55 that is seen employed around the two covered middle fingertips and the palm of the glove 30. Besides increasing ball control and grip to the exterior of the bowling ball surface 50, incremental, yet additional friction and stored energy can be imparted to the exterior surface of the ball by these two fingers 21 and 24 at point of ball release off the hand onto the lanes. FIG. 5 also shows the glove secured to the hand via an adjustable, tension strap 31, made from the same or similar control/grip-enhanced material as the palm material 30, which is used in gripping the exterior ball surface 50; the strap shown partially. The purpose of the adjustable tension strap 31 and slits 32 having been previously explained in FIGS. 1, 3, and 4.

FIG. 6 shows a magnified and partial view of the curled (i.e. bent) middle fingers 22 and 23, of the left-hand 42, in one example; the two middle fingers shown inserted into the finger sleeves of the 4-way stretch, abrasion-resistant, breathable fabric 29 of the present glove invention of FIG. 1 and, which the fingertips of 22 and 23 shown partially exposed. The view highlights the grip-enhanced, elastomeric material 25. Also viewable is the connecting relationship between the grip-enhanced material 25 and the 4-way stretch, abrasion-resistant, breathable fabric 29, which it attaches to. As already described, the grip-enhanced material 25 attached to the fabric 29 completely eradicates perspiration from coming into contact with any part of the bowling ball exterior or interior where either 25 or 29 has contact with, especially with respect to contact, rather absence of perspiration contact with the interior walls of the bored finger holes of a bowling ball, thereby providing the bowler a substantially more consistent and effective ball release off of the fingertips. The bowler consequently, can impart a higher degree of stored energy to and through the bowling ball due to the friction generated between the grip-enhanced material 25 against the interior walls of the finger holes of the bowling ball. One knowledgeable in the art of bowling may appreciate that a strong, frictional ball release off of the hand and, more specifically, the two middle fingers 22 and 23, as illustrated in FIGS. 4, 5, and 7, to a lesser degree, when the forefinger and pinky finger come into play, translates into a higher rev rate and an increase in stored ball energy, resulting in a high potential of sustained ball revolutions ("revs"), which translates into increased pin scattering at point of impact, ultimately increasing scoring potential.

FIG. 7 shows a palm-up view of an elongated embodiment of the present glove invention of FIG. 1; the glove of which is shown placed over the left hand 42; the left hand holding a bowling ball 50 in a "cupped" position, cradling the ball in the palm of the hand. In FIG. 7, in actuality, the fingers cannot be seen, as they are inserted. The illustration merely emphasizes the control/grip-enhanced material 25 surrounding the two middle fingertips 22 and 23, which are in a curved position, making direct and flush contact against the interior walls of their respective finger holes 51 of the bowling ball 50. The thumb is shown inserted into its respective hole of a bowling ball 50 and, is not meant to depict a material-covered thumb, though it does not imply that the thumb cannot be covered in a similar fashion as the middle fingertips 22 and 23 and inserted. As previously explained in FIGS. 1, 2, 4 5, and 6, the control/grip-enhanced material 25 prevents perspiration secreted around the covered, inserted fingertips 22 and 23 from coming into contact with the interior walls of the finger holes 51.

This materialed, control/grip-enhanced, elastomeric surface surrounding the inserted two middle fingers eliminates potential slippage and a less than ideal frictional contact between the finger holes, or inserts/grips if used, and the otherwise, bare, uncovered, and inserted two middle fingers. Maximum frictional contact and the "suction effect" which is desired and results between the inserted fingers 22 and 23 and their respected finger holes 51 is essential for a "clean" finger exit. This optimal and desired, snug relationship between inserted fingers and their respected finger holes of a bowling ball will significantly increasing ball control throughout the pendulum arm swing, maximizing revolution potential of the ball 50 off the hand and, more specifically, off the two middle fingers 22 and 23 at point of release of the ball onto the lane.

FIG. 7 also illustrates for effect only, the ball 50 cradled in the palm of the hand, the exterior of the ball surface making flush contact against the control/grip-enhanced material along the palm area 30 and adjustable tension strap 31; the slits 32 of the present glove invention of FIG. 1, shown partially. The control/grip-enhanced material of the palm side of the glove 30 and the control/grip-enhanced material of the adjustable tension strap 31 in one example of the invention afford the bowler increased control of ball position in the hand during set-up, allowing the bowler to securely position the ball at various angles in the "cup" of the bowling hand without the ball slipping off, as would normally occur with an otherwise naked, uncovered hand, due to the perspiration secretion factor that would normally take place on the palm of a bare hand. The position of the bowling ball in hand during the bowler's ready position on the approach has a cause and effect relationship with respect to ball axis, tilt and rotation of the ball as the ball is released off the hand and fingers onto the lane, as has been previously explained in FIG. 1.

FIG. 7, the elongated embodiment of the present glove invention of FIG. 1, highlights the wrist area of the glove, as earlier described in FIG. 4; the function and purpose of the adjustable tension strap 37, shown in partial view over the wrist area, is to restrict rotational movement of the wrist, providing the bowler a measure of support in the wrist area, as some bowlers desire or require support of the wrist due to age, bone disease, arthritis or weakness of the wrist in general, especially when holding, controlling and/or rolling a heavy object, such as a bowling ball 50. The adjustable tension strap 37, made from the same or similar control/grip-enhanced material used in the adjustable tension strap on the palm area of the glove 31, is interlaced through incisioned slits 38, securing over and around the wrist, securing to itself via a hook and loop clasp fastener system; the function and purpose being previously elaborated upon in FIGS. 1, 3 and 4.

FIG. 8 shows a backside, elevational view of the present glove invention of FIG. 1, illustrating the various components of the glove and the clam-like manner in which the present glove invention 20 is placed over either the left or right hand, due to its unique interchangeable features, making the present glove invention compatible with either the right or left hand of a person of similar hand size and shape, that is, providing the pinky finger remains naked and uncovered to the natural elements; the conditions which have been previously elaborated upon in FIG. 1.

Shown is one example of the cylindrically-shaped, control/grip-enhanced, elastomeric material 25 which horizontally circumferences the two middle fingers, leaving openings 43 and 44 at the very top of the fingertip area of the two middle finger sleeves of the glove to allow the very tips (i.e. tops) of the covered two middle fingers to be exposed to the natural environment, aiding in the evaporation of any perspiration build-up around the covered fingertip portion of these two fingers. Other configurations, however, may be employed and are contemplated as falling within the scope of the invention. Attached to the control/grip-enhanced, elastomeric material 25 around the two middle fingers is an elastic, 4-way stretch, perspiration-retention and breathable fabric material 29, which would cover the balance of the two middle fingers down to the approximate big knuckles of said fingers. As earlier elaborated upon in FIG. 1, as an exclusive feature of the present glove invention is its interchangeability, a key characteristic in the combined employment of the elastic fabric 29 and the control/grip-enhanced material 25, which possesses elastomeric properties, is that although a person's middle finger is normally slightly longer and bigger in circumference than the ring finger or index finger, the 4-way stretch characteristic of the fabric 29 and elastomericity of the control/grip-enhanced material 25 allows for the two middle fingers of either the left hand or right hand to fit comfortably all the way up to the opening tips 43 and 44 of either accommodating finger sleeve.

FIG. 8 illustrates one embodiment of the present glove invention 20 and, reveals a coated or laminated material 36, which is affixed to and fits like a mirror image to a control/grip-enhanced material 40 in a sandwich-like manner, with this underside of the back of the glove 40 having direct contact with the back of the hand of the person wearing the glove. The palm area of the glove 30 and 39, made from the same or similar control/grip-enhanced material as the underside of the back of the glove 40, with 30 and 39 also being a mirror image of each other, likewise, affixes to each other in a sandwich-like manner, with the underside of the palm area 39 making flush contact with the palm of the hand and, thus the topside of the palm area of the glove 30 having direct, frictional, non-skid contact with the exterior surface of a bowling ball. FIG. 8 also illustrates the adjustable, tension strap 31, made from the same or similar control/grip-enhanced, elastomeric material as used in 25, 30, 39 and/or 40, interlaced through the slits 32 and wrapping around to secure to itself on the back of the hand via a fastening material adhered to the adjustable tension strap, such as VELCRO®.

As earlier expanded upon in FIGS. 1, 3 and 4, the adjustable tension strap, made from the same or a similar control/grip-enhanced material can be removed from the slits 32 and reinserted in an interlacing manner in the opposite direction, securing to anywhere along the back of the hand, palm area of the hand, either side of the bowler's hand or, anywhere throughout the circumference of the hand where the strap intersects the hand, to suit the personal desires of the individual bowler. Furthermore, the strap 31 can be flipped over with its underside exposed up; the strap then reinserted through the slits 32 in either one direction or the other, securing to itself along any part of the hand where the adjustable tension strap bisects the hand, again, depending on one's personal comfort preferences.

FIG. 9 shows a back-of-the-hand view of an elongated embodiment of the present glove invention of FIG. 1, positioned over the right hand of a bowler 41, shown covering a portion of the back of the hand and extending down over the wrist area. As already described in FIGS. 1, 7, and 8, the present glove invention of FIG. 1 is interchangeable, that is, under the condition that the pinky finger 21 remains uncovered and bare, exposed to the elements. Therefore, in one example, the present glove invention and embodiments excluding the pinky finger 21 will accommodate either the right or left hand of a bowler. Though FIG. 9 shows the glove placed over the right hand 41, the view of the glove worn over the left hand would be a mirror image of this view, as if a left hand illustration were presented instead of a right hand illustration; again, providing the pinky finger 21 remains uncovered and naked, exposed to the natural environment. Consequently, the use of a right hand 41 in FIG. 9 is for demonstration and explanation purposes only and, in no way detracts from the basic principles of application should the elongated embodiment of the present glove invention be shown placed over the left hand and middle two fingers 22 and 23, with or without employing the index finger 24 as a further embodiment, as illustrated in phantom. Only if an embodiment of the present glove invention incorporates the pinky finger 21 covered with a 4-way stretch, elastic, perspiration-retention and breathable fabric 29 (as illustrated in phantom), will the interchangeability feature of the present glove invention be incompatible in this example, due to the obvious difference in length between the pinky finger 21 and the other three fingers 22, 23, and 24 of the average individual, regardless of age or size. However, as earlier described, should an embodiment to the present glove invention include encompassing the forefinger 24 with the 4-way stretch, elastic, perspiration-retention and breathable fabric 29 and a grip-enhanced material along the underside of the forefinger (for gripping purposes), this in addition to the two middle fingers 22 and 23, while the pinky finger 21 remains uncovered, naked and exposed to the elements, the interchangeable feature of the present glove invention of FIG. 1 remains unaffected.

FIG. 9 and the preceding views and descriptions, as well as any embodiments of the present glove invention have been presented for purposes of illustration and description only. They are not intended to be exhaustive or to limit the invention to the precise forms disclosed, and many modifications and variations to the present glove invention are possible beyond what FIG. 9 and any other views here depict. FIG. 9 shows the control/grip-enhanced, elastomeric material 25 surrounding the two middle fingers 22 and 23 with the very tips (i.e. tops) of the two middle fingers exposed to the natural elements. The function, purpose, and textural surface options, both exteriorly and interiorly of the control/grip-enhanced, elastomeric material has already been elaborated upon in FIGS. 1, 2, 3, 4, 5, 6, 7, and 8. Likewise, the 4-way stretch, elastic, perspiration-retention and breathable fabric 29, shown attached to the control/grip-enhanced material at the fingertip end of the glove 25 and to the coated or laminated material of the backside of the glove 36 has been previously discussed in FIGS. 3 and 8.

Also shown in FIG. 9 are the two (2) adjustable tension straps; the narrower adjustable tension strap 31 bisecting the approximate center of the hand, and the wider adjustable tension strap 37 of the elongated embodiment of the present glove invention of FIG. 1 is illustrated covering and supporting the wrist area, the purpose of this strap 37 having been previously explained in FIGS. 4 and 7. As earlier explained, both adjustable tension straps 31 and 37 are made from the same or similar control/grip-enhanced material used in 25 and on the palm side and area of the glove. Both adjustable tension straps 31 and 37 are secured to themselves via VELCRO® or a similar hook-and-loop fastening system, also previously discussed in FIGS. 1, 3, 4, 5, 7 and 8. This adjustable tension strap 37 provides the bowler taut, wrist support throughout the entire approach and delivery process; the complete purposes of which have been previously discussed in FIGS. 4 and 7. The coated or laminated material 36 allows the bowler to adjust the glove anywhere along the length of the back of the glove to achieve the desired location, position or tension of the glove to the bowling hand and/or wrist without disturbing the two (2) adjustable tension straps 31 and 37, which secures the glove to the hand and wrist areas.

FIG. 10 shows two (2) close-up, isolated views of possible embodiments 60 and 61, examples of textured control/grip-enhanced materials that could surround the fingertip area 25 of the present glove invention of FIG. 1 in conjunction with, or in place of a smoother, less textured or non-textured, control/grip-enhanced material. As earlier explained in FIGS. 1, 2, 4, 5, 6, and 7, the control/grip-enhanced material has a direct cause and effect relationship between the inserted, covered fingers and the amount of friction which is generated at point of release between the covered fingers against the interior walls of the finger holes. The control/grip-enhanced material 60 is an example of a raised or "domed", "dot-coated" surface; the material of which is of an appropriate durometer hardness, resulting in grip-like properties, such as would be found in a PVC, urethane, polyurethane, rubber, silicone-rubber, or similar material. The control/grip-enhanced material 61 is an example of a raised, "mesh-like" surface; the material of which is of an ideal durometer hardness, resulting in grip-like properties, such as would be found in a PVC, urethane, polyurethane, rubber, silicone-rubber, or similar material. These two (2) embodiments 60 and 61 are merely examples of the wide range of options available to create different control/grip-enhanced surfaces and effects. Due to the variances and differences between bowler's styles, abilities and differences at imparting revs to and through the bowling ball and, with respect to the wide range of lane conditions faced, (very oily→very dry lane surface conditions), the present glove invention contemplates various control/grip-enhanced surface textures at 25, each having a direct impact on achieving the desired ball revolutions necessary at point of release of the ball off the hand and fingers. The bowler can now make adjustments, factoring which surface texture matches up best to his/her natural capabilities, equipment selection and land conditions faced, and select a glove having the desired properties associated therewith. Alternatively, the elements 25 may be selectively detachable to the material 29, thereby allowing a single glove to be utilized with differing property end materials based on preferences and/or lane conditions, for example.

These embodiments 60 and 61, related to the control/grip-enhanced material used at 25 have been presented for purposes of illustration and description only. They are not intended to be exhaustive or to limit the invention to the precise forms disclosed, and obviously many modifications and variations are possible beyond what FIG. 10 depicts.

Also shown in FIG. 10 is the 4-way stretch, abrasion-resistant, breathable fabric 29, which attaches to the control/grip-enhanced material and, which has already been previously explained. Again, the foregoing descriptions of the present glove invention of FIG. 1 and embodiments of the present glove invention shown here have been presented for purposes of illustration and description. They are neither intended to be exhaustive nor to limit the invention to the precise forms disclosed; and obviously, many modifications and variations are possible in light of the above teaching. The embodiments and views were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. Apparatus for the hand of a user, comprising:

a. a palm portion sized and configured to cover a portion of the palm of the user's hand and having a first free edge proximate the thumb of the user and leaving the user's thumb uncovered by the apparatus;

b. a back portion sized and configured to cover a portion of the back of the user's hand and having a second free edge proximate the thumb of the user and leaving the user's thumb uncovered by the apparatus;

c. a middle finger tip portion sized and configured to circumferentially cover a distal portion of the user's middle finger;

d. a ring finger tip portion sized and configured to circumferentially cover a distal portion of the user's ring finger;

e. a middle finger insertion portion made of a material different from the middle finger tip portion and different from the palm portion, the middle finger insertion portion sized and configured to circumferentially cover the middle knuckle of the user's middle finger, the middle finger insertion portion extending between and connected to both the middle finger tip portion and the palm portion, and the middle finger insertion portion having a third free edge proximate the user's index finger, which is uncovered by the apparatus; and f. a ring finger insertion portion made of a material different from the ring finger tip portion and different from the palm portion, the ring finger insertion portion sized and configured to circumferentially cover the middle knuckle of the user's ring finger, the ring finger insertion portion extending between and connected to both the ring finger tip portion and the palm portion, and the ring finger insertion portion having a fourth free edge proximate the user's little finger, which is uncovered by the apparatus.

2. The apparatus for the hand of a user according to claim 1, wherein the middle finger tip portion is sized and configured to leave exposed the tip of the user's middle finger and further wherein the ring finger tip portion is sized and configured to leave exposed the tip of the user's ring finger.

3. The apparatus for the hand of a user according to claim 1, wherein an external surface of the middle finger tip portion and an external surface of the ring finger tip portion of the apparatus are grip-enhancing, and further wherein an external surface of the palm portion is grip-enhancing.

4. The apparatus for the hand of a user according to claim 1, wherein an external surface of the middle finger tip portion and an external surface of the ring finger tip portion of the apparatus are grip-enhancing and abrasion-resistant, and further wherein an external surface of the palm portion is grip-enhancing and abrasion-resistant.

5. The apparatus for the hand of a user according to claim 1, wherein the palm portion is sized and configured with free edges leaving a portion of the user's palm adjacent the user's index finger uncovered by the apparatus and a portion of the user's palm adjacent the user's little finger uncovered by the apparatus, and further wherein the back portion is sized and configured with free edges leaving a portion of the back of the user's hand adjacent the user's index finger uncovered by the apparatus and a portion of the back of the user's hand adjacent the user's little finger uncovered by the apparatus.

6. The apparatus for the hand of a user according to claim 3, wherein the palm portion is sized and configured with free edges leaving a portion of the user's palm adjacent the user's index finger uncovered by the apparatus and a portion of the user's palm adjacent the user's little finger uncovered by the apparatus, and further wherein the back portion is sized and configured with free edges leaving a portion of the back of the user's hand adjacent the user's index finger uncovered by the apparatus and a portion of the back of the user's hand adjacent the user's little finger uncovered by the apparatus.

7. The apparatus for the hand of a user according to claim 4, wherein the palm portion is sized and configured with free edges leaving a portion of the user's palm adjacent the user's index finger uncovered by the apparatus and a portion of the user's palm adjacent the user's little finger uncovered by the apparatus, and further wherein the back portion is sized and configured with free edges leaving a portion of the back of the user's hand adjacent the user's index finger uncovered by the apparatus and a portion of the back of the user's hand adjacent the user's little finger uncovered by the apparatus.

8. The apparatus for the hand of a user according to claim 1, wherein the palm portion has at least two longitudinal slits extending therethrough, and wherein the apparatus further comprises an adjustable strap for securing the apparatus to the user's hand, the strap extending through the slits of the palm portion and extending around to the back portion to secure the apparatus to the user's hand, wherein the strap and slits cooperate to permit the strap to be positioned and secured at a selected position comfortable to the user, and further wherein the strap and slits cooperate to permit the strap to be removed from the slits, reversed, and reinserted into the slits, permitting right-hand use or left-hand use of the apparatus.

9. The apparatus for the hand of a user according to claim 3, wherein the palm portion has at least two longitudinal slits extending therethrough, and wherein the apparatus further comprises an adjustable strap for securing the apparatus to the user's hand, the strap extending through the slits of the palm portion and extending around to the back portion to secure the apparatus to the user's hand, wherein the strap and slits cooperate to permit the strap to be positioned and secured at a selected position comfortable to the user, and further wherein the strap and slits cooperate to permit the strap to be removed from the slits, reversed, and reinserted into the slits, permitting right-hand use or left-hand use of the apparatus.

10. The apparatus for the hand of a user according to claim 4, wherein the palm portion has at least two longitudinal slits extending therethrough, and wherein the apparatus further comprises an adjustable strap for securing the apparatus to the user's hand, the strap extending through the slits of the palm portion and extending around to the back portion to secure the apparatus to the user's hand, wherein the strap and slits cooperate to permit the strap to be positioned and secured at a selected position comfortable to the user, and further wherein the strap and slits cooperate to permit the strap to be removed from the slits, reversed, and reinserted into the slits, permitting right-hand use or left-hand use of the apparatus.

11. The apparatus for the hand of a user according to claim 5, wherein the palm portion has at least two longitudinal slits extending therethrough, and wherein the apparatus further comprises an adjustable strap for securing the apparatus to the user's hand, the strap extending through the slits of the palm portion and extending around to the back portion to secure the apparatus to the user's hand, wherein the strap and slits cooperate to permit the strap to be positioned and secured at a selected position comfortable to the user, and further wherein the strap and slits cooperate to permit the strap to be removed from the slits, reversed, and reinserted into the slits, permitting right-hand use or left-hand use of the apparatus.

12. The apparatus for the hand of a user according to claim 6, wherein the palm portion has at least two longitudinal slits extending therethrough, and wherein the apparatus further comprises an adjustable strap for securing the apparatus to the user's hand, the strap extending through the slits of the palm portion and extending around to the back portion to secure the apparatus to the user's hand, wherein the strap and slits cooperate to permit the strap to be positioned and secured at a selected position comfortable to the user, and further wherein the strap and slits cooperate to permit the strap to be removed from the slits, reversed, and reinserted into the slits, permitting right-hand use or left-hand use of the apparatus.

13. The apparatus for the hand of a user according to claim 7, wherein the palm portion has at least two longitudinal slits extending therethrough, and wherein the apparatus further comprises an adjustable strap for securing the apparatus to the user's hand, the strap extending through the slits of the palm portion and extending around to the back portion to secure the apparatus to the user's hand, wherein the strap and slits cooperate to permit the strap to be positioned and secured at a selected position comfortable to the user, and further wherein the strap and slits cooperate to permit the strap to be removed from the slits, reversed, and reinserted into the slits, permitting right-hand use or left-hand use of the apparatus.

14. The apparatus for the hand of a user according to claim 12, wherein an external palm surface of the strap is exposed while the strap extends through the slits and the apparatus is secured to the user's hand with the strap, and wherein the exposed external palm surface of the strap comprises a grip-enhancing material.

15. The apparatus for the hand of a user according to claim 13, wherein an external palm surface of the strap is exposed while the strap extends through the slits and the apparatus is secured to the user's hand with the strap, and wherein the exposed external palm surface of the strap comprises a grip-enhancing material.

16. The apparatus for the hand of a user according to claim 1, wherein the grip-enhancing external surfaces of the middle finger tip portion and ring finger tip portion of the apparatus comprise a raised, mesh surface having a plurality of openings.

17. The apparatus for the hand of a user according to claim 3, wherein the grip-enhancing external surfaces of the middle finger tip portion and ring finger tip portion of the apparatus comprise a raised, mesh surface having a plurality of openings.

18. The apparatus for the hand of a user according to claim 12, wherein the grip-enhancing external surfaces of the middle finger tip portion and ring finger tip portion of the apparatus comprise a raised, mesh surface having a plurality of openings.

19. The apparatus for the hand of a user according to claim 14, wherein the grip-enhancing external surfaces of the middle finger tip portion and ring finger tip portion of the apparatus comprise a raised, mesh surface having a plurality of openings.

20. The apparatus for the hand of a user according to claim 19, wherein free edges of the middle finger insertion portion and the ring finger insertion portion cooperate to define an opening exposing the web of the user's hand between the user's middle and ring fingers.

* * * * *